US011450177B2

(12) United States Patent
Acres

(10) Patent No.: US 11,450,177 B2
(45) **Date of Patent: *Sep. 20, 2022**

(54) MEANS FOR ENHANCING GAME PLAY OF GAMING DEVICE

(71) Applicant: Acres Technology, Las Vegas, NV (US)

(72) Inventor: John F. Acres, Las Vegas, NV (US)

(73) Assignee: ACRES TECHNOLOGY, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/197,383

(22) Filed: Mar. 10, 2021

(65) Prior Publication Data

US 2021/0201620 A1 Jul. 1, 2021

Related U.S. Application Data

(60) Continuation of application No. 16/442,791, filed on Jun. 17, 2019, now Pat. No. 10,964,164, which is a continuation of application No. 15/641,961, filed on Jul. 5, 2017, now abandoned, which is a division of application No. 12/981,091, filed on Dec. 29, 2010, now Pat. No. 9,728,043.

(51) Int. Cl.
*G07F 17/32* (2006.01)
*G07F 17/34* (2006.01)

(52) U.S. Cl.
CPC ..... *G07F 17/326* (2013.01); *G07F 17/3267* (2013.01); *G07F 17/32* (2013.01); *G07F 17/3244* (2013.01); *G07F 17/34* (2013.01)

(58) Field of Classification Search
CPC .... G07F 17/32; G07F 17/3244; G07F 17/326; G07F 17/34; G07F 17/3267
USPC ..... 463/16, 20–22, 42
See application file for complete search history.

(56) References Cited

U.S. PATENT DOCUMENTS 2,669,389 A 2/1954 Mesi et al.
3,124,355 A 3/1964 Mentzer
(Continued)

FOREIGN PATENT DOCUMENTS

CA 2754756 1/2007
CN 1842826 A 10/2006
(Continued)

OTHER PUBLICATIONS

U.S. Appl. No. 12/616,070, filed Nov. 10, 2009 to Acres.
(Continued)

*Primary Examiner* — Chase E Leichliter
(74) *Attorney, Agent, or Firm* — Ballard Spahr LLP

(57) ABSTRACT

Embodiments of the present concept provide gaming devices and gaming systems that are configured to implement means for enhancing game play. Here, various embodiments of this concept use game insertion techniques to enhance the game play experience for players. These game insertion techniques include placing bonus spins, free games, or other incentives within traditional game play. In one model, a gaming device may use a bonus spin routine to replace a losing game outcome with a winning game outcome. Here, the player may be shown the initial losing game outcome and then be notified that a bonus spin has been awarded, which ultimately results in the winning game outcome.

21 Claims, 12 Drawing Sheets

(56) References Cited

U.S. PATENT DOCUMENTS 3,124,674 A 3/1964 Edwards
3,684,290 A 8/1972 Wayne
3,727,213 A 4/1973 Kurtenbach
3,751,040 A 8/1973 Carey
4,240,635 A 12/1980 Brown
4,254,404 A 3/1981 White
4,433,844 A 2/1984 Hooker et al.
4,624,459 A 11/1986 Kaufman
4,657,256 A 4/1987 Okada
4,669,731 A 6/1987 Clarke
4,836,546 A 6/1989 DiRe et al.
4,887,813 A 12/1989 Chiles, III et al.
5,022,653 A 6/1991 Suttle et al.
5,024,439 A 6/1991 Okada
5,027,102 A 6/1991 Sweeny
5,031,914 A 7/1991 Rosenthal
5,078,405 A 1/1992 Jones et al.
5,083,785 A 1/1992 Okada
5,152,529 A 10/1992 Okada
5,178,395 A 1/1993 Lovell
5,221,083 A 6/1993 Dote
5,265,880 A 11/1993 Maksymec
5,342,049 A 8/1994 Wichinsky et al.
5,364,104 A 11/1994 Jones et al.
5,377,973 A 1/1995 Jones et al.
5,380,008 A * 1/1995 Mathis ..... G07F 17/3262 463/20
5,490,670 A 2/1996 Hobert
5,536,016 A 7/1996 Thompson
5,564,700 A 10/1996 Celona
5,584,485 A 12/1996 Jones et al.
5,586,766 A 12/1996 Forte et al.
5,655,961 A 8/1997 Acres et al.
5,674,128 A 10/1997 Holch et al.
5,695,402 A 12/1997 Stupak
5,697,844 A 12/1997 Kohorn
5,743,798 A 4/1998 Adams et al.
5,758,875 A 6/1998 Giacalone, Jr.
5,766,076 A 6/1998 Pease et al.
5,816,918 A 10/1998 Kelly et al.
5,830,064 A 11/1998 Bradish et al.
5,836,816 A 11/1998 Bruin et al.
5,836,817 A 11/1998 Acres et al.
5,851,147 A 12/1998 Stupak et al.
5,910,048 A 6/1999 Feinberg
5,913,726 A 6/1999 Jones et al.
5,934,998 A 8/1999 Forte et al.
5,941,770 A 8/1999 Miers et al.
5,960,406 A 9/1999 Rasansky et al.
5,984,779 A 11/1999 Bridgeman et al.
6,003,013 A 12/1999 Boushy et al.
6,012,983 A 1/2000 Walker et al.
6,024,642 A 2/2000 Stupak
6,030,109 A 2/2000 Lobsenz
6,032,955 A 3/2000 Luciano et al.
6,045,130 A 4/2000 Jones et al.
6,048,272 A 4/2000 Tsujita
6,059,659 A 5/2000 Busch et al.
6,077,163 A 6/2000 Walker et al.
6,086,477 A 7/2000 Walker et al.
6,106,395 A 8/2000 Begis
6,110,041 A 8/2000 Walker et al.
6,110,043 A 8/2000 Olsen
6,135,884 A 10/2000 Hedrick et al.
6,146,273 A 11/2000 Olsen
6,165,071 A 12/2000 Weiss
6,168,521 B1 1/2001 Luciano et al.
6,183,362 B1 2/2001 Boushy
6,186,893 B1 2/2001 Walker et al.
6,196,918 B1 3/2001 Miers et al.
6,210,276 B1 4/2001 Mullins
6,217,448 B1 4/2001 Olsen
6,224,482 B1 5/2001 Bennet
6,234,900 B1 5/2001 Cumbers
6,254,483 B1 7/2001 Acres
6,264,560 B1 7/2001 Goldberg et al.
6,270,409 B1 8/2001 Shuster
6,289,382 B1 9/2001 Bowman-Amuah
6,293,866 B1 9/2001 Walker et al.
6,293,868 B1 9/2001 Bernard
6,302,793 B1 10/2001 Fertitta, III et al.
6,315,662 B1 11/2001 Jorasch et al.
6,315,666 B1 11/2001 Mastera et al.
6,319,122 B1 11/2001 Packes et al.
6,319,125 B1 11/2001 Acres
6,186,892 B1 12/2001 Frank et al.
6,336,859 B2 1/2002 Jones et al.
6,347,996 B1 2/2002 Gilmore et al.
6,364,314 B1 4/2002 Canterbury
6,364,768 B1 4/2002 Acres et al.
6,368,216 B1 4/2002 Hedrick et al.
6,371,852 B1 4/2002 Acres
6,375,567 B1 4/2002 Acres
6,390,917 B1 5/2002 Walker et al.
6,425,823 B1 7/2002 Byrne
6,428,002 B1 8/2002 Baranauskas
6,443,456 B1 9/2002 Gajor
6,454,648 B1 9/2002 Kelly et al.
6,457,045 B1 9/2002 Hanson et al.
6,471,588 B2 10/2002 Sakamoto
6,485,367 B1 11/2002 Joshi
6,485,368 B2 11/2002 Jones et al.
6,508,710 B1 1/2003 Paravia et al.
6,520,856 B1 2/2003 Walker et al.
6,537,150 B1 3/2003 Luciano et al.
6,565,434 B1 5/2003 Acres
6,565,436 B1 5/2003 Baerlocher
6,569,013 B1 5/2003 Taylor
6,575,832 B1 6/2003 Manfredi et al.
6,592,457 B1 7/2003 Frohm et al.
6,599,186 B1 7/2003 Walker et al.
6,599,193 B2 7/2003 Baerlocher et al.
6,606,615 B1 8/2003 Jennings et al.
6,620,046 B2 8/2003 Rowe
6,634,922 B1 10/2003 Driscoll et al.
6,645,068 B1 11/2003 Kelly et al.
6,648,757 B1 11/2003 Slomiany et al.
6,652,378 B2 11/2003 Cannon et al.
6,656,047 B1 12/2003 Tarantino et al.
6,695,700 B2 2/2004 Walker et al.
6,697,165 B2 2/2004 Wakai et al.
6,702,670 B2 3/2004 Jasper et al.
6,709,331 B2 3/2004 Berman
6,712,693 B1 3/2004 Hettinger
6,712,695 B2 3/2004 Mothwurf et al.
6,722,985 B2 4/2004 Criss-Puszkiewicz et al.
6,749,510 B2 6/2004 Giobbi
6,751,657 B1 6/2004 Zothner
6,755,420 B2 6/2004 Colton
6,758,754 B1 7/2004 Lavanchy et al.
6,760,595 B2 7/2004 Inselberg
6,780,104 B2 8/2004 Fox
6,786,824 B2 9/2004 Cannon
6,800,026 B2 10/2004 Cannon
6,800,027 B2 10/2004 Giobbi et al.
6,802,778 B1 10/2004 Lemay et al.
6,811,482 B2 11/2004 Letovsky
6,811,486 B1 11/2004 Luciano, Jr.
6,860,808 B2 3/2005 Levitan
6,860,810 B2 3/2005 Cannon et al.
6,939,227 B2 9/2005 Jorasch et al.
6,944,509 B2 9/2005 Altmaier et al.
6,948,171 B2 9/2005 Dan et al.
6,965,868 B1 11/2005 Bednarek
6,973,665 B2 12/2005 Dudkiewicz et al.
RE38,982 E 2/2006 Forte et al.
6,997,380 B2 2/2006 Safaei et al.
6,998,806 B2 2/2006 Suzuki
7,037,195 B2 5/2006 Schneider et al.
7,048,628 B2 * 5/2006 Schneider ..... G07F 17/32 463/16
7,056,210 B2 6/2006 Bansemer et al.
7,069,232 B1 6/2006 Fox et al.
7,090,579 B2 8/2006 Tarantino

(56) References Cited

U.S. PATENT DOCUMENTS 7,094,149 B2 8/2006 Walker et al.
7,094,150 B2 8/2006 Ungaro et al.
7,103,560 B1 9/2006 Fox et al.
7,131,908 B2 11/2006 Baerlocher
7,144,322 B2 12/2006 Gomez et al.
7,160,189 B2 1/2007 Walker et al.
7,169,052 B2 1/2007 Beaulieu et al.
7,175,521 B2 2/2007 McClintic
7,182,690 B2 2/2007 Giobbo et al.
7,184,965 B2 2/2007 Fox et al.
7,186,181 B2 3/2007 Rowe
7,192,346 B2 3/2007 Mathis
7,195,243 B2 3/2007 Kenny et al.
7,201,654 B1 4/2007 Jarvis et al.
7,210,998 B2 5/2007 Kazaoka et al.
7,251,805 B2 7/2007 Koo
7,300,351 B2 11/2007 Thomas
7,329,185 B2 2/2008 Conover et al.
7,338,372 B2 3/2008 Morrow et al.
7,361,089 B2 4/2008 Daly et al.
7,374,486 B2 5/2008 Baerlocher
7,384,338 B2 6/2008 Rothschild et al.
7,406,516 B2 7/2008 Davis et al.
7,410,422 B2 8/2008 Fine
7,416,186 B2 8/2008 Walker et al.
7,458,892 B2 12/2008 Walker et al.
7,500,916 B2 3/2009 Lieberman et al.
7,594,851 B2 9/2009 Falconer
7,601,060 B2 10/2009 Baerlocher et al.
7,628,691 B2 12/2009 Luciano et al.
7,674,180 B2 3/2010 Graham et al.
7,704,137 B2 4/2010 Englman
7,717,788 B2 5/2010 Rowe
7,744,453 B2 6/2010 Pacey
7,762,886 B2 7/2010 Pfennighausen et al.
7,765,121 B2 7/2010 Pace et al.
7,775,875 B2 8/2010 Nguyen et al.
7,775,876 B2 8/2010 Rowe
7,780,520 B2 8/2010 Baerlocher
7,811,167 B2 10/2010 Giobbi et al.
7,846,018 B2 12/2010 Baerlocher
7,857,693 B1 12/2010 Johnson et al.
7,874,911 B2 1/2011 Walker et al.
7,942,735 B2 5/2011 Meyer et al.
7,963,844 B2 6/2011 Walker et al.
8,052,517 B2 11/2011 Manfredi et al.
8,062,124 B2 * 11/2011 Jaffe ..... G07F 17/3244 463/16
8,133,105 B2 3/2012 Walker et al.
8,313,369 B2 11/2012 Acres
8,475,254 B2 7/2013 Acres
8,545,319 B2 10/2013 Kaneko
8,602,866 B2 12/2013 Acres
8,956,214 B2 2/2015 Acres
9,501,907 B2 11/2016 Acres
9,619,973 B2 4/2017 Acres
9,659,442 B2 5/2017 Acres
9,721,423 B2 8/2017 Acres
9,865,133 B2 1/2018 Acres
9,997,007 B2 6/2018 Acres
10,032,341 B2 7/2018 Acres
2001/0004609 A1 6/2001 Walker et al.
2001/0024015 A1 9/2001 Hogan et al.
2001/0046893 A1 11/2001 Giobbi et al.
2001/0048193 A1 12/2001 Yoseloff et al.
2002/0013173 A1 1/2002 Walker et al.
2002/0016202 A1 2/2002 Fertitta et al.
2002/0019253 A1 2/2002 Reitzen et al.
2002/0032052 A1 3/2002 Levitan
2002/0034981 A1 3/2002 Hisada
2002/0039923 A1 4/2002 Cannon et al.
2002/0055381 A1 5/2002 Tarantino
2002/0058545 A1 5/2002 Luciano
2002/0086726 A1 7/2002 Ainsworth
2002/0094855 A1 7/2002 Berman
2002/0103018 A1 8/2002 Rommerdahl et al.
2002/0107072 A1 8/2002 Giobbi
2002/0143652 A1 8/2002 Beckett
2002/0123376 A1 9/2002 Walker et al.
2002/0132664 A1 9/2002 Miller et al.
2002/0142825 A1 10/2002 Lark et al.
2002/0147040 A1 10/2002 Walker et al.
2002/0147043 A1 10/2002 Shulman et al.
2002/0147049 A1 10/2002 Russell
2002/0152120 A1 10/2002 Howington
2002/0167126 A1 11/2002 De Raedt et al.
2002/0177480 A1 11/2002 Rowe
2002/0177483 A1 11/2002 Cannon
2002/0187834 A1 12/2002 Rowe et al.
2002/0193162 A1 12/2002 Walker et al.
2002/0196342 A1 12/2002 Walker et al.
2003/0003988 A1 1/2003 Walker et al.
2003/0003989 A1 1/2003 Johnson
2003/0013512 A1 1/2003 Rowe
2003/0013516 A1 1/2003 Walker et al.
2003/0017865 A1 1/2003 Beaulieu et al.
2003/0032474 A1 2/2003 Kaminkow
2003/0036425 A1 2/2003 Kaminkow et al.
2003/0054875 A1 3/2003 Marks et al.
2003/0054878 A1 3/2003 Benoy et al.
2003/0054881 A1 3/2003 Hedrick et al.
2003/0060276 A1 3/2003 Walker et al.
2003/0064769 A1 4/2003 Muir
2003/0064771 A1 4/2003 Morrow et al.
2003/0067116 A1 4/2003 Colton
2003/0078088 A1 * 4/2003 Schneider ..... G07F 17/3281 463/16
2003/0078101 A1 4/2003 Schneider et al.
2003/0083943 A1 5/2003 Adams et al.
2003/0087685 A1 5/2003 Hogan et al.
2003/0092484 A1 5/2003 Schneider et al.
2003/0100360 A1 5/2003 Manfredi et al.
2003/0114217 A1 6/2003 Walker et al.
2003/0119575 A1 6/2003 Centouri et al.
2003/0125103 A1 * 7/2003 Tessmer ..... G07F 17/3262 463/20
2003/0135304 A1 7/2003 Sroub et al.
2003/0144048 A1 7/2003 Silva
2003/0178774 A1 9/2003 Marcilio
2003/0186733 A1 10/2003 Wolf et al.
2003/0187736 A1 10/2003 Teague et al.
2003/0190944 A1 10/2003 Manfredi et al.
2003/0195029 A1 10/2003 Frohm et al.
2003/0199295 A1 10/2003 Vancura
2003/0199312 A1 10/2003 Walker et al.
2003/0204474 A1 10/2003 Capek et al.
2003/0207711 A1 11/2003 Rowe
2003/0209853 A1 11/2003 Harris
2003/0211884 A1 11/2003 Gauselmann
2003/0216169 A1 11/2003 Walker et al.
2003/0220138 A1 11/2003 Walker et al.
2003/0220139 A1 11/2003 Peterson
2003/0220143 A1 11/2003 Shteyn et al.
2003/0228901 A1 12/2003 Walker et al.
2003/0232640 A1 12/2003 Walker et al.
2003/0234489 A1 12/2003 Okada
2003/0236110 A1 12/2003 Beaulieu et al.
2004/0002369 A1 1/2004 Walker et al.
2004/0009808 A1 1/2004 Gauselmann
2004/0029631 A1 2/2004 Duhamel
2004/0038735 A1 2/2004 Steil et al.
2004/0038736 A1 2/2004 Bryant et al.
2004/0048650 A1 3/2004 Mierau et al.
2004/0053657 A1 3/2004 Fiden et al.
2004/0053681 A1 3/2004 Jordan et al.
2004/0063484 A1 4/2004 Oreaper et al.
2004/0072609 A1 4/2004 Ungaro et al.
2004/0103013 A1 5/2004 Jameson
2004/0121833 A1 6/2004 Mezen et al.
2004/0142742 A1 7/2004 Schneider et al.
2004/0158536 A1 8/2004 Kowal et al.
2004/0166918 A1 8/2004 Walker et al.
2004/0166940 A1 8/2004 Rothschild
2004/0180722 A1 9/2004 Giobbi

(56) References Cited

U.S. PATENT DOCUMENTS

2004/0185932 A1 9/2004 Lombardo
2004/0198485 A1 10/2004 Loose et al.
2004/0203611 A1 10/2004 Laporta et al.
2004/0204213 A1 10/2004 Schugar et al.
2004/0204216 A1 10/2004 Schugar
2004/0204222 A1 10/2004 Roberts
2004/0214637 A1 10/2004 Nonaka
2004/0219967 A1 11/2004 Giobbi et al.
2004/0224750 A1 11/2004 Al-Ziyoud
2004/0229671 A1 11/2004 Stronach et al.
2004/0229683 A1 11/2004 Mothwurf et al.
2004/0229700 A1 11/2004 Cannon et al.
2004/0235542 A1 11/2004 Stronach et al.
2004/0248642 A1 12/2004 Rothschild
2004/0254010 A1 12/2004 Fine
2004/0266517 A1 12/2004 Bleich et al.
2005/0014558 A1 1/2005 Estey
2005/0026674 A1 2/2005 Wolf et al.
2005/0043072 A1 2/2005 Nelson
2005/0043086 A1 2/2005 Schneider
2005/0043088 A1 2/2005 Nguyen et al.
2005/0043092 A1 2/2005 Gauselmann
2005/0043094 A1 2/2005 Nguyen et al.
2005/0049028 A1 3/2005 Gomez et al.
2005/0054438 A1 3/2005 Rothschild et al.
2005/0056995 A1 3/2005 Tempest
2005/0059467 A1 3/2005 Saffari et al.
2005/0064926 A1 3/2005 Walker et al.
2005/0070356 A1 3/2005 Mothwurf et al.
2005/0075164 A1 4/2005 Krynicky
2005/0096121 A1 5/2005 Gilliland et al.
2005/0096124 A1 5/2005 Stronach
2005/0101375 A1 5/2005 Webb et al.
2005/0101379 A1 5/2005 Falconer
2005/0119052 A1 6/2005 Russell et al.
2005/0124411 A1 6/2005 Schneider et al.
2005/0124415 A1 6/2005 Centuori et al.
2005/0148377 A1 7/2005 Goldberg et al.
2005/0148380 A1 7/2005 Cannon et al.
2005/0148383 A1 7/2005 Mayeroff
2005/0153773 A1 7/2005 Nguyen et al.
2005/0164764 A1 7/2005 Ghaly
2005/0181856 A1 8/2005 Cannon et al.
2005/0181860 A1 8/2005 Nguyen et al.
2005/0181862 A1 8/2005 Asher et al.
2005/0187014 A1 8/2005 Saffari et al.
2005/0192080 A1* 9/2005 Cote ..... G07F 17/3265 463/20
2005/0208995 A1 9/2005 Marshall et al.
2005/0215311 A1 9/2005 Hornik et al.
2005/0215314 A1* 9/2005 Schneider ..... G07F 17/3244 463/26
2005/0215316 A1 9/2005 Rowe et al.
2005/0233794 A1 10/2005 Cannon et al.
2005/0239541 A1 10/2005 Jorasch et al.
2005/0239545 A1 10/2005 Rowe
2005/0251440 A1 11/2005 Bednarek
2005/0255902 A1 11/2005 Lind
2005/0266905 A1 12/2005 Emori et al.
2006/0009284 A1 1/2006 Schwartz et al.
2006/0025205 A1 2/2006 Casey et al.
2006/0025207 A1 2/2006 Walker et al.
2006/0025210 A1 2/2006 Johnson
2006/0030391 A1 2/2006 Casey et al.
2006/0030400 A1 2/2006 Mathis
2006/0040723 A1 2/2006 Baerlocher et al.
2006/0040730 A1 2/2006 Walker et al.
2006/0046816 A1 3/2006 Walker
2006/0046830 A1 3/2006 Webb
2006/0046835 A1 3/2006 Walker et al.
2006/0052160 A1 3/2006 Saffari et al.
2006/0058095 A1 3/2006 Berman et al.
2006/0058097 A1 3/2006 Berman et al.
2006/0063578 A1 3/2006 Bansemer et al.
2006/0068898 A1 3/2006 Maya
2006/0068899 A1 3/2006 White et al.
2006/0068903 A1* 3/2006 Walker ..... G07F 17/32 463/25
2006/0073872 A1 4/2006 B-Jensen et al.
2006/0073884 A1 4/2006 Walker et al.
2006/0073887 A1 4/2006 Nguyen et al.
2006/0079310 A1 4/2006 Friedman et al.
2006/0079314 A1 4/2006 Walker et al.
2006/0084496 A1 4/2006 Jaffe et al.
2006/0094493 A1 5/2006 Kido
2006/0100009 A1 5/2006 Walker et al.
2006/0105836 A1 5/2006 Walker et al.
2006/0116201 A1 6/2006 Gauselmann
2006/0121972 A1 6/2006 Walker et al.
2006/0121981 A1 6/2006 Pfenninghausen et al.
2006/0128467 A1 6/2006 Thomas
2006/0135249 A1 6/2006 Seelig et al.
2006/0148559 A1 7/2006 Jordan et al.
2006/0149632 A1 7/2006 Register et al.
2006/0154714 A1 7/2006 Montross et al.
2006/0174270 A1 8/2006 Westberg et al.
2006/0183530 A1 8/2006 Ellis
2006/0183536 A1 8/2006 Gagner et al.
2006/0189378 A1* 8/2006 Aoki ..... G07F 17/3213 463/20
2006/0189363 A1 9/2006 Strom
2006/0199631 A1 9/2006 McGill et al.
2006/0205483 A1 9/2006 Meyer et al.
2006/0211486 A1 9/2006 Walker et al.
2006/0217175 A1 9/2006 Walker et al.
2006/0229127 A1 10/2006 Walker et al.
2006/0234791 A1 10/2006 Nguyen et al.
2006/0247034 A1 11/2006 Schneider et al.
2006/0247041 A1 11/2006 Walker et al.
2006/0252510 A1 11/2006 Walker et al.
2006/0252512 A1 11/2006 Walker et al.
2006/0252516 A1 11/2006 Walker et al.
2006/0258422 A1 11/2006 Walker et al.
2006/0258425 A1 11/2006 Edidin et al.
2006/0258432 A1 11/2006 Packer et al.
2006/0287034 A1 12/2006 Englman et al.
2006/0287045 A1 12/2006 Walker et al.
2006/0287098 A1 12/2006 Morrow et al.
2006/0287102 A1 12/2006 White et al.
2007/0001396 A1 1/2007 Walker et al.
2007/0010309 A1 1/2007 Giobbi et al.
2007/0010315 A1 1/2007 Hein
2007/0050256 A1 3/2007 Walker et al.
2007/0054733 A1 3/2007 Baerlocher
2007/0060252 A1 3/2007 Taylor
2007/0060274 A1 3/2007 Rowe et al.
2007/0060323 A1 3/2007 Isaac et al.
2007/0060387 A1 3/2007 Enzminger et al.
2007/0082727 A1 4/2007 Ebisawa et al.
2007/0087806 A1* 4/2007 Luciano ..... G07F 17/3267 463/16
2007/0087818 A1 4/2007 Walker et al.
2007/0105615 A1 5/2007 Lind
2007/0105618 A1 5/2007 Steil
2007/0106553 A1 5/2007 Jordan et al.
2007/0111776 A1 5/2007 Griswold et al.
2007/0112609 A1 5/2007 Howard et al.
2007/0117619 A1 5/2007 Walker et al.
2007/0117623 A1 5/2007 Nelson et al.
2007/0129147 A1 6/2007 Gagner
2007/0135214 A1 6/2007 Walker et al.
2007/0143156 A1 6/2007 van Deursen
2007/0167210 A1 7/2007 Kelly et al.
2007/0184897 A1 8/2007 Fujimoto
2007/0191087 A1 8/2007 Thomas et al.
2007/0191089 A1 8/2007 Yoshizawa
2007/0197247 A1 8/2007 Inselberg
2007/0205556 A1 9/2007 Roemer et al.
2007/0259709 A1 11/2007 Kelly et al.
2007/0275777 A1 11/2007 Walker et al.
2007/0293302 A1 12/2007 Lind et al.
2008/0015004 A1 1/2008 Gatto et al.
2008/0015006 A1* 1/2008 George ..... G07F 17/3286 463/17

(56) References Cited

U.S. PATENT DOCUMENTS

2008/0039190 A1 2/2008 Walker et al.
2008/0045317 A1 2/2008 Seelig et al.
2008/0058105 A1 3/2008 Combs et al.
2008/0064495 A1 3/2008 Bryant et al.
2008/0076576 A1 3/2008 Graham et al.
2008/0090651 A1 4/2008 Baerlocher
2008/0096636 A1 4/2008 Power
2008/0102921 A1 5/2008 Urquhart
2008/0102935 A1 5/2008 Finnimore
2008/0102946 A1 5/2008 Amour
2008/0108423 A1 5/2008 Benbrahim et al.
2008/0108433 A1 5/2008 DiMichele et al.
2008/0113744 A1* 5/2008 Whitcher ..... G07F 17/32 463/20
2008/0113749 A1 5/2008 Williams et al.
2008/0113777 A1* 5/2008 Anderson ..... G07F 17/3244 463/25
2008/0113779 A1 5/2008 Cregan
2008/0113811 A1 5/2008 Linard et al.
2008/0119283 A1 5/2008 Baerlocher
2008/0132320 A1 6/2008 Rodgers
2008/0146331 A1 6/2008 Nordman et al.
2008/0153564 A1 6/2008 Baerlocher et al.
2008/0153596 A1 6/2008 Nguyen
2008/0171586 A1 7/2008 Roemer
2008/0176647 A1 7/2008 Acres
2008/0182655 A1 7/2008 DeWaal et al.
2008/0207313 A1 8/2008 Acres
2008/0220840 A1 9/2008 Katz et al.
2008/0220861 A1 9/2008 Okada
2008/0227551 A1 9/2008 Kelly et al.
2008/0234035 A1 9/2008 Malek
2008/0242394 A1 10/2008 Sakuma
2008/0242398 A1 10/2008 Harris et al.
2008/0248851 A1 10/2008 Bloom
2008/0254886 A1 10/2008 Kelly
2008/0261699 A1 10/2008 Topham et al.
2008/0268959 A1 10/2008 Bryson et al.
2008/0280674 A1 11/2008 Sakuma
2008/0287186 A1 11/2008 Sakuma
2008/0293467 A1 11/2008 Mathis
2008/0311973 A1* 12/2008 Jaffe ..... G07F 17/3258 463/20
2008/0318656 A1 12/2008 Walker et al.
2009/0005170 A9 1/2009 Kelly et al.
2009/0036202 A1 2/2009 Baerlocher et al.
2009/0069068 A1* 3/2009 Cole ..... G07F 17/3223 463/20
2009/0070081 A1 3/2009 Saenz et al.
2009/0075728 A1 3/2009 Acres
2009/0088239 A1 4/2009 Iddings et al.
2009/0088252 A1 4/2009 Nicely et al.
2009/0093289 A1 4/2009 Toyoda
2009/0117981 A1 5/2009 Yoshizawa
2009/0118005 A1 5/2009 Kelly et al.
2009/0124327 A1 5/2009 Caputo et al.
2009/0124364 A1 5/2009 Cuddy et al.
2009/0131175 A1 5/2009 Kelly et al.
2009/0170608 A1 7/2009 Herrmann et al.
2009/0176580 A1 7/2009 Herrmann et al.
2009/0233682 A1 9/2009 Kato et al.
2009/0239601 A1 9/2009 Macke
2009/0239622 A1 9/2009 Fujimori et al.
2009/0239628 A1 9/2009 Fujimori et al.
2009/0239648 A1 9/2009 Acres
2009/0239660 A1 9/2009 Acres
2009/0239661 A1 9/2009 Acres
2009/0247284 A1 10/2009 Sugiyama et al.
2009/0253477 A1 10/2009 Teranishi
2009/0253478 A1 10/2009 Walker et al.
2009/0253490 A1 10/2009 Teranishi
2009/0258693 A1 10/2009 Preston
2009/0270168 A1 10/2009 Englman et al.
2009/0286590 A1 11/2009 Bennet
2009/0325669 A1 12/2009 Kelly et al.
2009/0325670 A1 12/2009 Kelly et al.
2010/0016055 A1 1/2010 Englman
2010/0041464 A1 2/2010 Arezina et al.
2010/0048286 A1 2/2010 Okada et al.
2010/0056248 A1 3/2010 Acres
2010/0075741 A1 3/2010 Aoki et al.
2010/0105454 A1 4/2010 Weber et al.
2010/0105466 A1 4/2010 Inamure et al.
2010/0113130 A1 5/2010 Kamano et al.
2010/0120492 A1 5/2010 Davis et al.
2010/0124960 A1 5/2010 Lutnick et al.
2010/0124967 A1 5/2010 Lutnick et al.
2010/0124981 A1 5/2010 Kato et al.
2010/0124988 A1 5/2010 Amos et al.
2010/0210336 A1 8/2010 Berman et al.
2010/0210338 A1 8/2010 Taylor
2010/0285867 A1 11/2010 Okada
2010/0304834 A1 12/2010 Okada
2011/0034237 A1* 2/2011 Schulhof ..... G07F 17/3293 463/43
2011/0039615 A1 2/2011 Acres
2011/0081958 A1 4/2011 Herrmann et al.
2011/0081964 A1 4/2011 Acres
2011/0159950 A1 6/2011 Okada
2011/0165938 A1 7/2011 Anderson et al.
2011/0218030 A1 9/2011 Acres
2011/0275438 A9 11/2011 Hardy et al.
2011/0281632 A1 11/2011 Okada
2011/0287826 A1 11/2011 Kato et al.
2011/0294563 A1 12/2011 Jaffe
2012/0077565 A1 3/2012 Barbalet
2012/0108337 A1 5/2012 Kelly et al.
2012/0115566 A1 5/2012 Fujisawa et al.
2012/0122558 A1 5/2012 Lyons et al.
2012/0135800 A1 5/2012 Acres
2012/0172108 A1 7/2012 Acres
2012/0172130 A1 7/2012 Acres
2012/0190425 A1 7/2012 Barbalet
2012/0270638 A1* 10/2012 Eubanks ..... G07F 17/326 463/25
2017/0178845 A1 6/2017 Acres
2017/0228977 A1 8/2017 Acres
2017/0301175 A1 10/2017 Acres
2017/0301180 A1 10/2017 Acres
2018/0082537 A1 3/2018 Acres
2018/0253930 A1 9/2018 Acres
2018/0342133 A1 11/2018 Acres
2019/0304240 A1 10/2019 Acres

FOREIGN PATENT DOCUMENTS

CN 101043922 A 9/2007
EP 141264 5/1985
EP 896304 2/1999
EP 896308 2/1999
EP 919965 6/1999
EP 981397 3/2000
EP 1091789 4/2001
EP 1231577 8/2002
EP 1351180 10/2003
EP 1369830 12/2003
EP 1490849 12/2004
EP 1496419 1/2005
EP 1623375 2/2006
EP 1637196 3/2006
EP 1832952 9/2007
JP 2-21883 1/1990
WO 95/21665 8/1995
WO 95/31262 11/1995
WO 96/35490 11/1995
WO 97/46293 12/1997
WO 00/17825 3/2000
WO 00/32286 6/2000
WO 00/64545 11/2000
WO 01/36059 5/2001
WO 01/59680 8/2001
WO 01/80961 11/2001
WO 03/066179 8/2003
WO 03/089092 10/2003

(56) References Cited

FOREIGN PATENT DOCUMENTS

| | | | |
|---|---|---|---|
| WO | 2004/046859 | | 6/2004 |
| WO | 2005008514 | | 1/2005 |
| WO | 2005/029279 | | 3/2005 |
| WO | 2005/029287 | | 3/2005 |
| WO | 2005/099845 | | 10/2005 |
| WO | 2005/113093 | | 12/2005 |
| WO | 2006/014745 | | 2/2006 |
| WO | 2006/014770 | | 2/2006 |
| WO | 2006/014990 | | 2/2006 |
| WO | 2006/032498 | | 3/2006 |
| WO | 2006023401 | A1 | 3/2006 |
| WO | 2006/036948 | | 4/2006 |
| WO | 2006/055518 | | 5/2006 |
| WO | 2006/060442 | | 6/2006 |
| WO | 2006/060493 | | 6/2006 |
| WO | 2007/087286 | | 8/2007 |
| WO | 2008/024705 | | 2/2008 |

OTHER PUBLICATIONS

"White Paper: An Analysis of Harrah's Total Rewards Program" written and published by Gaming Market Advisor on or before Dec. 31, 2006, retreived URL <http://www.gamingmarketadvisors.com/publications/Harrahs%20Total%20Reward%20White%20Paper.pdf>, 41 pages.

Acres, John, An Ingenious Internet Marketing Tool, Slot Operations Management / Casino Enterprise Management, Aug. 2007, pp. 8-10.

Acres, John, Measuring the Player Experience: What a Squiggly Line Can Tell You, Inside Edge / Slot Manager, Jan. / Feb., pp. 28-29.

Acres, John, The Future of Gaming, Where Will You be in 10 Years? Slot Operations Management, / Casino Enterprise Management, Jul. 2007, pp. 8-10, 12.

* cited by examiner

MEANS FOR ENHANCING GAME PLAY OF GAMING DEVICE

RELATED APPLICATIONS

This application is a continuation of U.S. patent application Ser. No. 16/442,791, filed Jun. 17, 2019, which is a continuation of U.S. patent application Ser. No. 15/641,961 filed Jul. 5, 2017, now abandoned, which is a divisional of U.S. patent application Ser. No. 12/981,091 filed on Dec. 29, 2010, now U.S. Pat. No. 9,728,043 issued on Aug. 8, 2017, which are incorporated herein by reference in their entirety.

This application is related to the following U.S. patent applications: U.S. patent application Ser. No. 15/622,903 filed Jun. 14, 2017, which is a divisional of U.S. patent application Ser. No. 12/980,990, filed Dec. 29, 2010, now U.S. Pat. No. 9,704,331 issued Jul. 11, 2017, both entitled MEANS FOR CONTROLLING PAYBACK PERCENTAGE OF GAMING DEVICE, and U.S. patent application Ser. No. 15/636,989 filed Jun. 29, 2017, which is a continuation of U.S. patent application Ser. No. 12/981,048, filed Dec. 29, 2010, now U.S. Pat. No. 9,721,423, issued Aug. 1, 2017, both entitled EVENT-BASED GAMING OPERATION FOR GAMING DEVICE. The disclosures of the above-listed applications are incorporated herein by reference in their entirety for all purposes.

FIELD OF THE INVENTION

This disclosure relates generally to gaming devices, and more particularly to gaming devices and gaming systems that are configured to enhance the game play of games being played on the gaming devices.

BACKGROUND

Game outcomes on gaming devices are typically determined at random where winning outcomes are awarded to a player in the form of money, credits, promotions, prizes, or other incentives, and losing outcomes typically result only in a lost wager. Player excitement is typically generated by providing the possibility of winning large awards for a relatively meager wager. Indeed, for most players, the excitement and gratification of gambling is tied to achieving wins. While these players will endure certain periods of loss, players will often press the spin and/or bet buttons as quickly as possible to pass through the losses to get to another win. Business principles require that most outcomes not be large winning outcomes for the player. Thus, many gambling sessions include extended periods that are devoid of large winning outcomes. Even during a more balanced gaming session, a great portion of time on a gaming device is spent watching reels spin (poker hands played, etc.) with a resulting loss. It is understood that these losses must be balanced with giving the player some incentive to keep playing, and casinos look for ways to maintain player interest in the gaming device besides providing wins.

Gaming machines typically operate with a random number generator (RNG) that generates a numeric code by which to determine a game outcome. For example, a slot machine is often constructed of 3 reels, with a multiplicity of symbols placed on each. Certain combinations of symbols that align on a center payline are designated as winning outcomes and are assigned award amounts. Other outcomes are losing outcomes that generally are not associated with an award. If each reel is equipped with 22 positions, there are 22×22×22 (10,648) possible combinations that can appear on a single payline.

By varying the quantity and value of symbols placed on each reel, a variety of payback percentages are obtainable. To help create more flexibility in generating payback percentages, some games use longer reel strips with more symbols or use virtual reel strips that map one or more possible outcomes to each position on a reel strip. Many games are created with multiple paytables that having varying payback percentages. Casino operators are typically able to select a particular paytable for each game. Thus, casinos in popular locations may choose paytables with lower payback percentages during peak days or hours and select paytables with a higher payback percentage at slower times to entice more gambling. Additionally, casinos in more remote locations may choose paytables with significantly higher payback percentages to attract players to their game floors. Hence, the flexibility afforded by providing multiple paytables in a single game is important for casinos.

Over the past 15 years or so, bonusing has become a popular method for incentivizing players. Bonuses can be controlled by a bonus engine (also known as a bonus server) to decide when to award a bonus at a particular game and how big that bonus award should be. Bonus wins of this nature are not funded by the base game's paytable. These bonuses, while exciting when received, are typically fairly large-value awards and hence are won relatively infrequently. Hence, they do not typically play a large role in most gaming sessions.

DETAILED DESCRIPTION

Figure 1:
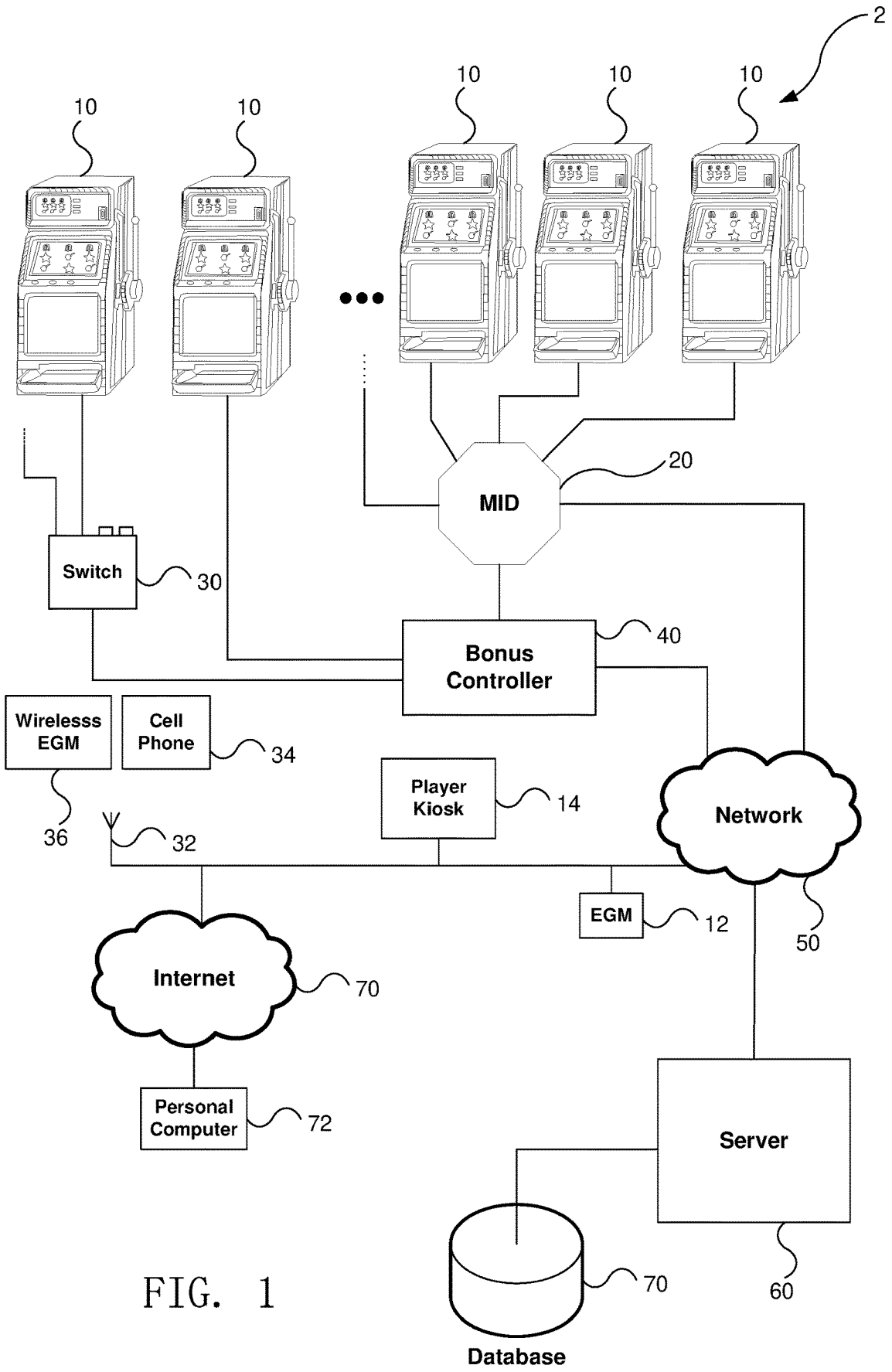
FIG. 1 is a system diagram illustrating various components of a gaming system according to embodiments of the invention.

FIG. 1 is a system diagram illustrating various components of a gaming system according to embodiments of the invention. Referring to FIG. 1, the gaming system 2 includes several gaming devices, also referred to as Electronic Gaming Machines (EGMs) 10 that are connected to a gaming network 50 through various communication mechanisms.

In general, a gaming network 50 connects any of a number of EGMs 10, or other gaming devices, such as those described below, for central management. Accounting and other functions may be served by a connected server 60 and database 70. For example many player tracking functions, bonusing systems, and promotional systems may be centrally administrated from the server 60 and database 70. In some embodiments there may be multiple servers 60 and databases 70, each performing different functions. In other embodiments functions may be combined and operate on a single or small group of servers 60, each with their own database 70 or combined databases.

Many of the EGMs 10 of FIG. 1 connect to the gaming network 50 through a Machine Interface Device, MID 20. In general, the MID 20 is a multi-protocol interface that monitors communication between the gaming network 50 and the EGM 10. In a common embodiment, the MID 20 communicates to the EGM 10 through a standard gaming network port, using a standard gaming network protocol, SAS, which is well known in the gaming industry. Most modern games include at least one communication port, which is commonly a SAS port or a port for another communication protocol. The MID 20, along with its various functions and communication methods is described in detail with reference to FIGS. 3A and 3B below.

Other EGMs 10 in FIG. 1 connect to the gaming network 50 through a bonus controller 40, which may be coupled between the gaming network 50 and gaming device 10. The bonus controller 40 generally communicates through a non-SAS protocol, such as another well-known communication protocol known as GSA. GSA is typically carried over an Ethernet network, and thus the bonus controller 40 includes an Ethernet transceiver, which is described with reference to FIG. 4 below. Because the bonus controller 40 communication may be Ethernet based, a switch 30 may be used to extend the number of devices that may be coupled to the bonus controller 40. The bonus controller 40 and/or the MID 20 may create or convert data or information received according to a particular protocol, such as SAS, into data or information according to another protocol, such as GSA. In this way the MID 20 and bonus controller 40 are equipped to communicate, seamlessly, between any EGM 10 and gaming network 50 no matter which communication protocols are in use. Further, because the MID 20 and bonus controller 40 are programmable, and include multiple extensible communication methods, as described below, they are capable of communicating with EGMs 10 that will communicate using protocols and communication methods developed in the future.

Other games or devices on which games may be played are connected to the gaming network using other connection and/or communication methods. For instance, an EGM 12 may couple directly to the network 50 without any intervening hardware, other than hardware that is built into the EGM 12 to connect it to the network 50. Likewise, a player kiosk 14 may be directly coupled to the gaming network. The player kiosk 14 allows players, managers, or other personnel to access data on the gaming network 50, such as a player tracking record, and/or to perform other functions using the network. For example, a player may be able to check the current holdings of the player account, transfer balances, redeem player points for credits, cash, or other merchandise or coupons, such as food or travel coupons, for instance.

A wireless transceiver 32 couples the gaming network 50 to a wireless EGM 36, such as a handheld device, or, through a cell phone or other compatible data network, the transceiver 32 connects to a cellular phone 34. The cellular phone 34 may be a "smart phone," which in essence is a handheld computer capable of playing games or performing other functions on the gaming network 50, as described in some embodiments of the invention.

The gaming network 50 also couples to the internet 70, which in turn is coupled to a number of computers, such as the personal computer 72 illustrated in FIG. 1. The personal computer 72 may be used much like the kiosk 14, described above, to manage player tracking or other data kept on the gaming network 50. More likely, though, is that the personal computer 72 is used to play actual games in communication with the gaming network 50. Player data related to games and other functions performed on the personal computer 72 may be tracked as if the player were playing on an EGM 10.

In general, in operation, a player inserts a starting credit into one of the games, such as an EGM 10. The EGM 10 sends data through its SAS or other data communication port through the MID 20 and/or bonus controller 50 to the gaming network 50. Various servers 60 and databases 70 collect information about the gameplay on the EGM 10, such as wagers made, results, various pressing of the buttons on the EGM 10, for example. In addition, the SAS port on the EGM 10 may also be coupled, through the MID 20 as described below, to other systems, such as player tracking systems, accounting, and ticketing systems, such as Ticket-In-Ticket-Out (TITO) systems.

In addition, the EGM 10 accepts information from systems external to the EGM itself to cause the EGM 10 to perform other functions. For example, these external systems may drive the EGM 10 to issue additional credits to the player. In another example, a promotional server may direct the EGM 10 to print a promotional coupon on the ticket printer of the EGM.

The bonus controller 40 is structured to perform some of the above-described functions as well. For example, in addition to standard games on the EGM 10, the bonus controller 40 is structured to drive the EGM 10 to pay bonus awards to the player based on any of the factors, or combination of factors, related to the EGM 10, the player playing the EGM 10, particular game outcomes of the game being played, or other factors.

In this manner, the combination of the bonus controller 40 and MID 20 are a sub-system capable of interfacing with each of the EGMs on a gaming network 50. Through this interface, the MID 20 may gather data about the game, gameplay, or player, or other data on the EGM 10, and forward it to the bonus controller 40. The bonus controller 40 then uses such collected data as input and, when certain conditions are met, sends information and/or data to the EGM 10 to cause it to perform certain functions.

In a more detailed example, suppose a player is playing an EGM 10 coupled to the MID 20 and the bonus controller 40 described above. The player inserts a player tracking card so the gaming network 50 knows the player identity. The MID 20 also stores such identifying information, or perhaps stores only information that the player is a level-2 identified player, for instance. The MID 20 passes such information to the bonus controller 40, which has been programmed to provide a welcome-back bonus to any level-2 player after he or she has played two games. Gameplay on the EGM 10 continues and, after the player plays two games, the bonus controller 40 instructs the EGM 10 to add an additional 40 credits to the EGM 10 as the welcome-back bonus. Such monitoring and control of the EGM 10 can occur in conjunction with, but completely separate from any player tracking or bonusing function that is already present on the gaming network 50. In other words, the server 60, when structured at least in part as a bonusing server, may be set to provide a time-based bonus of 10 credits for every hour played by the player of the EGM 10. The above-described welcome-back bonus may be managed completely separately through the bonus controller 40 and MID 20. Further, all of the actions on the EGM 10 caused by the bonus controller 40 are also communicated to the standard accounting, tracking, and other systems already present on the gaming network 50.

Figure 2:
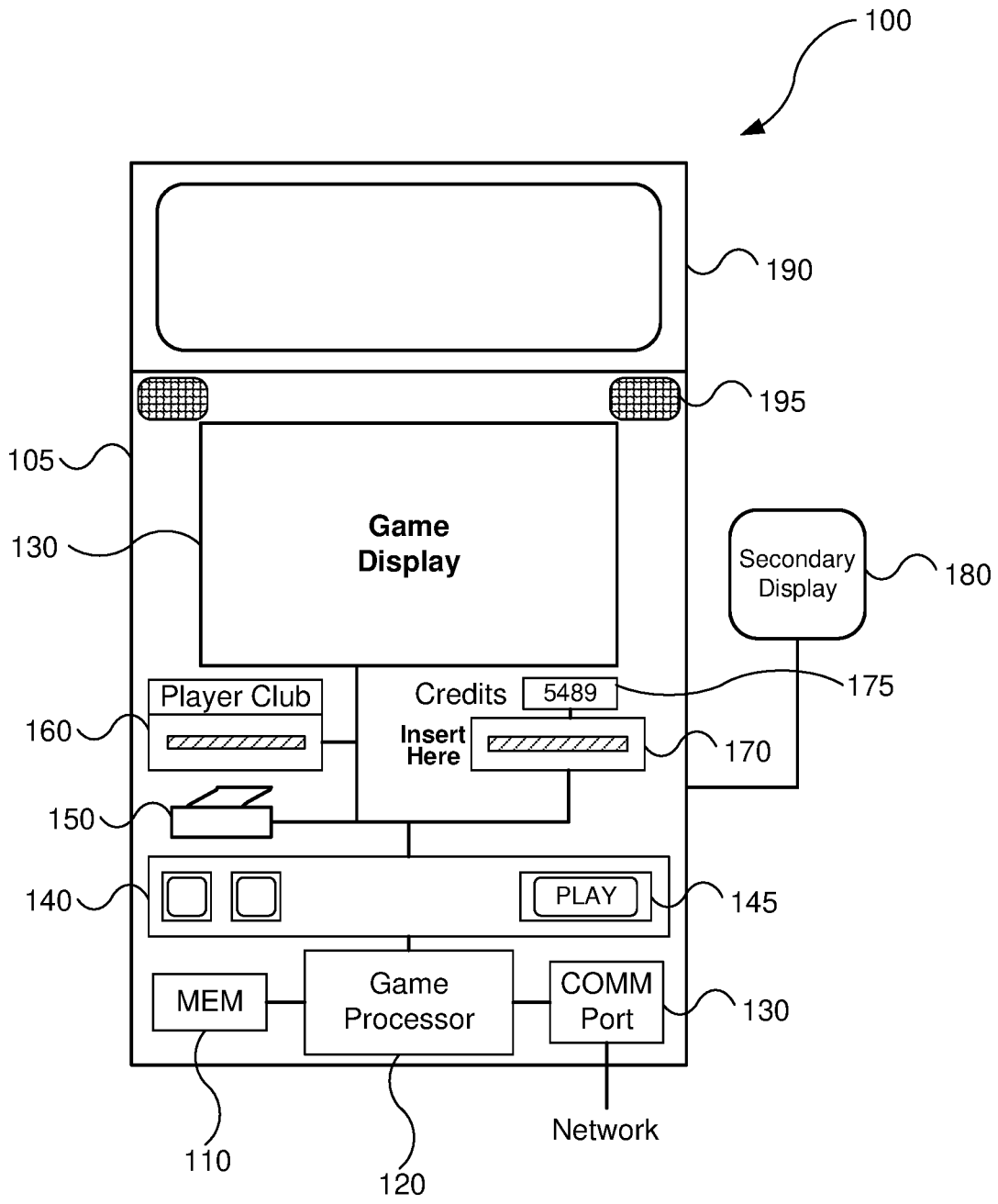
FIG. 2 is a functional block diagram that illustrates an example gaming device that can be a part of the gaming system shown in FIG. 1.

FIG. 2 is a functional block diagram that illustrates an example gaming device that can be a part of the gaming system shown in FIG. 1. Referring to FIG. 2, the illustrated gaming device 100 is an example of the EGMs 10, 12 that are shown in FIG. 1. These EGMs 10, 12 may include all types of electronic gaming machines, such as physical reel slot machines, video slot machines, video poker gaming devices, video blackjack machines, keno games, and any other type of devices may be used to wager monetary-based credits on a game of chance. As mentioned above, various other types of gaming devices may be connected to the network 50 (FIG. 1) such as wireless gaming devices 36, computers used for gaming purposes 72, cellular phones 34, multi-player gaming stations, server-based gaming terminals, etc.

Returning to FIG. 2, the illustrated gaming device 100 includes a cabinet 105 to house various parts of the gaming device 100, thereby allowing certain components to remain securely isolated from player interference, while providing access to player input/output devices so that the player may interact with the gaming device. The securely housed components include the game processor 120, memory 110, and connection port 130. The game processor 120, depending on the type of gaming device 100, may completely or partially control the operation of the gaming device. For example, if the gaming device 100 is a standalone gaming device, game processor 120 may control virtually all of the operations of the gaming device and attached equipment. In other configurations, the game processor 120 may implement instructions generated by or communicated from a remote server (e.g., server 60 shown in FIG. 1) or other controller. For example, the game processor 120 may be responsible for running a base game of the gaming device 100 and executing instructions received over the network 50 from a bonus server or player tracking server. In a server-based gaming environment, the game processor 120 may simply act as a terminal to perform instructions from a remote server that is running game play on the gaming device 100.

The memory 110 is connected to the game processor 120 and may be configured to store various game information about gameplay or player interactions with the gaming device 100. This memory may be volatile (e.g., RAM), non-volatile (e.g., flash memory), or include both types of memory. The connection port 130 is also connected to the game processor 120. This connection port 130 typically connects the gaming device 100 to a gaming network, such as the gaming network 50 described above. The connection port 130 may be structured as a serial port, parallel port, Ethernet port, optical connection, wireless antenna, or any other type of communication port used to transmit and receive data. Although only one connection port 130 is shown in FIG. 1, the gaming device 100 may include multiple connection ports. As described above, in many existing gaming devices, this connection port 130 is a serial connection port utilizing a SAS protocol to communicate to one or more remote game servers, such as player tracking servers, bonus servers, accounting servers, etc.

The player input/output devices housed by the gaming cabinet 105 include a game display 130, a button panel 140 having one or more buttons 145, a ticket printer 150, a bill/ticket reader 170, a credit meter 175, a player club interface device 160, and one or more game speakers 195. Various gaming devices may include fewer or more input/output devices (e.g., a game handle, a coin acceptor, a coin hopper, etc.) depending upon the configuration of the gaming device.

The gaming display 130 may have mechanical spinning reels, a video display, or include a combination of both spinning reels and a video display, or use other methods to display aspects of the gameplay to the player. If the gaming display 130 is a video display, the gaming display may include a touch screen to further allow the player to interact with game indicia, soft buttons, or other displayed objects. The button panel 140 allows the player to select and place wagers on the game of chance, as well as allowing the player to control other aspects of gaming. For example, some gaming devices allow the player to press a button 145 to signal that he or she requires player assistance. Other buttons may bring up a help menu and/or game information. The buttons 145 may also be used to play bonuses or make selections during bonus rounds.

Ticket printers 150 have relatively recently been included on most gaming devices to eliminate the need to restock coin hoppers and allow a player to quickly cash-out credits and transfer those credits to another gaming device. The tickets can also typically be redeemed for cash at a cashier cage or kiosk. The ticket printers are usually connected to the game processor and to a remote server, such as a TITO server to accomplish its intended purpose. In gaming devices that have more than one peripheral device, and which include only a single SAS port, the peripheral devices all share communication time over the connection port 130.

Another peripheral device that often requires communication with a remote server is the player club interface device 160. The player club interface device 160 may include a reader device and one or more input mechanisms. The reader is configured to read an object or indicia identifying the player. The identifying object may be a player club card issued by the casino to a player that includes player information encoded on the card. Once the player is identified by a gaming device, the player club interface device 160 communicates with a remote player server through the connection port 130 to associate a player account with the gaming device 100. This allows various information regarding the player to be communicated between the gaming device 100 and the player server, such as amounts wagered, credits won, and rate of play. In other embodiments, the card reader may read other identifying cards (such as driver licenses, credit cards, etc.) to identify a player. Although FIG. 2 shows the reader as a card reader, other embodiments may include a reader having a biometric scanner, PIN code acceptor, or other methods of identifying a player so as to pair the player with their player tracking account. As is known in the art, it is typically advantageous for a casino to encourage a player to join a player club since this may inspire loyalty to the casino, as well as give the casino information about the player's likes, dislikes, and gaming habits. To compensate the player for joining a player club, the casino often awards player points or other prizes to identified players during game play.

Other input/output devices of the gaming device 100 include a credit meter 175, a bill/ticket acceptor 170, and speakers 195. The credit meter 175 generally indicates the total number of credits remaining on the gaming device 100 that are eligible to be wagered. The credit meter 175 may reflect a monetary unit, such as dollars, or an amount of credits, which are related to a monetary unit, but may be easier to display. For example, one credit may equal one cent so that portion of a dollar won can be displayed as a whole number instead of decimal. The bill/ticket acceptor 170 typically recognizes and validates paper bills and/or printed tickets and causes the game processor 120 to display a corresponding amount on the credit meter 175. The speakers 195 play auditory signals in response to game play or may play enticing sounds while in an "attract-mode," when a player is not at the gaming device. The auditory signals may also convey information about the game, such as by playing a particularly festive sound when a large award is won.

The gaming device 100 may include various other devices to interact with players, such as light configurations, top box displays 190, and secondary displays 180. The top box display 190 may include illuminated artwork to announce a game style, a video display (such as an LCD), a mechanical and/or electrical bonus display (such as a wheel), or other known top box devices. The secondary display 180 may be a vacuum fluorescent display (VFD), a liquid crystal display (LCD), a cathode ray tube (CRT), a plasma screen, or the like. The secondary display 180 may show any combination of primary game information and ancillary information to the player. For example, the secondary display 180 may show player tracking information, secondary bonus information, advertisements, or player selectable game options. The secondary display may be attached to the game cabinet 105 or may be located near the gaming device 100. The secondary display 180 may also be a display that is associated with multiple gaming devices 100, such as a bank-wide bonus meter, or a common display for linked gaming devices.

In operation, typical play on a gaming device 100 commences with a player placing a wager on a game to generate a game outcome. In some games, a player need not interact with the game after placing the wager and initiating the game, while in other games, the player may be prompted to interact with the gaming device 100 during game play. Interaction between the player and the gaming device 100 is more common during bonuses, but may occur as part of the game, such as with video poker. Play may continue on the gaming device 100 until a player decides to cash out or until insufficient credits remain on the credit meter 175 to place a minimum wager for the gaming device.

Communication between gaming devices, such as those described above, and other devices on gaming systems 2 (FIG. 1) is becoming increasingly more complex. The below-described system illustrates a system and method of communication on modern and future gaming systems.

Figure 3A:
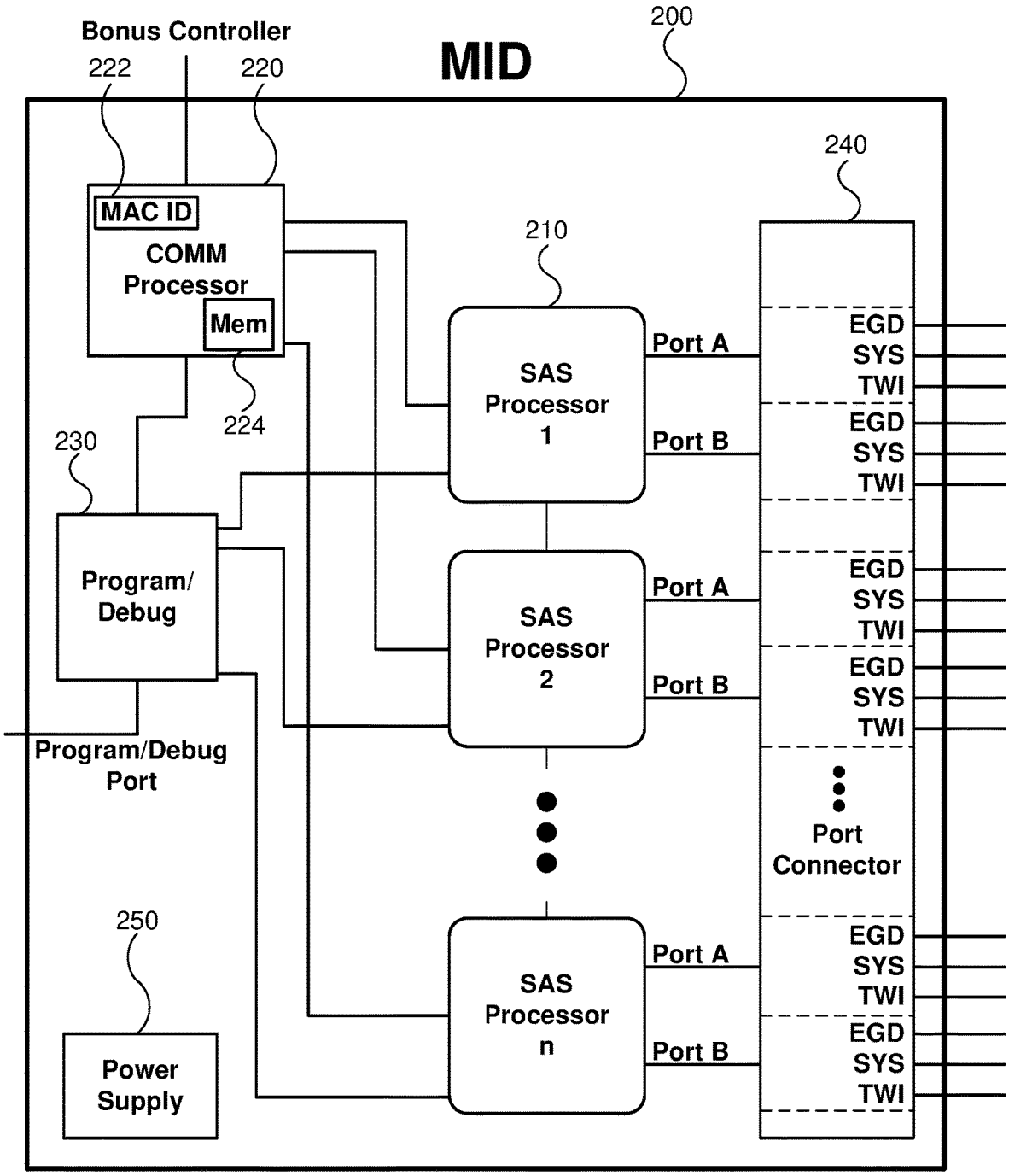
FIG. 3A is a block diagram of an example machine interface device shown in FIG. 1 according to embodiments of the invention.

FIG. 3A is a block diagram of a MID 200, which may be an example of the MID 20 described with reference to FIG. 1 above. The MID 200 includes a set of processors 210, which in this example are termed SAS processors. These SAS processors are capable of accepting, manipulating, and outputting data on a SAS protocol network.

The MID 200 is capable of communicating using other communication protocols as well, as described below. Each processor 210 is structured to couple to two Electronic Gaming Devices (EGDs). EGDs may include, for example, gaming devices such as EGM 10 of FIG. 1, or other electronic gaming devices. In the illustrated embodiment, each SAS processor 210 includes two ports, A and B, each of which may be coupled to an EGD. In turn, the two ports A and B are attached to a set of physical connectors, illustrated here as a single connector 240 for convenience of explanation. Each section of the physical connector 240, delineated by dotted lines, includes three separate pairs of communication lines. Each pair of communication lines is illustrated as a single line—a first serial pair labeled EGD, a second serial pair labeled SYS, and a third communication pair that uses two-wire communication, labeled TWI. Note that each of the ports A and B of the SAS processor 210 includes all three communication pairs. Additionally each of the sections of the physical connector 240 includes wires for a voltage and ground reference, though not depicted in FIG. 3A. In an embodiment of the MID 200 with four SAS processors 210, the physical connector 240 includes up to eight sections, each of which may be embodied by a separate, standard, RJ-45 connector to couple to a matching RJ-45 port in the connected EGM 10, or EGD, as determined by the specific implementation.

As illustrated in FIG. 3A, the first serial pair of Port A couples to EGD. The second serial pair may be coupled to external devices connected to the EGD, as needed. Specifically, some serial data protocols, such as SAS, do not allow EGMs 10 to interface with multiple external devices over a single serial communication path. Such external devices may include, for example, player tracking systems and accounting systems. If a particular EGM 10 is already connected to such a system, and thus its SAS port is "full," the MID 200, and in particular a SAS processor 210, may insert itself "between" the connected system and the EGM 10 by using both of the serial pairs in a particular port of the SAS processor 210 to couple to the EGM 10 and the other connected system, respectively. In operation, the MID 200, through the respective SAS processor 210, passes any information directed from the external device coupled to the SYS communication lines in a particular port to the EGD of the same port, or vice-versa, in real time and without interruption. For example, polls, requests for information, and transmission of information are passed from a connected player tracking system, through the SYS lines of Port A to the serial line EGD of Port A. Only a small communication delay is added using such a communication system, which is well within the tolerance limits of SAS protocol. As a result, both the EGM 10 and external system behave as if the MID 200 were not present.

Further, the third communication pair, a two-wire interface labeled TWI, presents opportunity for expansion to future systems installed on the EGM 10, or a new EGM, so that any data may be communicated between the EGM 10 and the MID 200. The TWI may be connected to card readers, top boxes, ticket dispensers, lighting panels, etc. that are coupled to or work in conjunction with an EGM 10.

Besides simply passing information between communication interfaces, the MID 200 also generates information directly for connected EGDs, which may originate from the MID 200 or from another device as described below. In such a case the SAS processor 210 sends the appropriate data through its appropriate serial line or two-wire interface directly to the desired EGD. Then the EGD may send its own data to its connected peripheral.

Referring back to FIG. 3A, the MID 200 additionally includes a communication processor 220, labeled as COMM processor. The communication processor 220 is coupled to each of the SAS processors 210, a program/debug circuit 230, and to a bonus controller 40 (FIG. 1). In practice, the communication processor 220 may be embodied by a small microprocessor, such as the Atmel ATXMEGA256A3, which is readily available to developers, or any other processor or system capable of performing the desired communication functions.

The communication processor 220 collects and aggregates information from the EGDs that are coupled to each of the SAS processors 210 and sends the aggregated information to the bonus controller 40 of FIG. 1. In some embodiments the communication processor 220 is coupled to the bonus controller 40 through an Ethernet interface. The communication processor is structured to parse information from Ethernet data packets and collect it for use by other systems within the MID 200. Because Ethernet is an addressed protocol, by which messages may be sent to a particular Ethernet address, the communication processor 220 also includes an address of the Ethernet device in a MAC ID 222.

The communication processor 220 may also accept information from the bonus controller 40, or other connected devices, and pass such information to the EGDs coupled to the SAS processors 210. The information may include data, instructions, or commands, for instance.

A memory 224, which may be, for instance Ferroelectric Random Access Memory (FRAM) capable of retaining stored contents for over 10 years may be used by the communication processor for both program and data storage. Of course, other memory technologies may be used instead of or in addition to FRAM.

A program/debug circuit 230 in the MID 200 connects to the communication processor 220 as well as to each of the SAS processors 210. During manufacture of the MID 200, the programming functions of the program/debug circuit 230 load program code to each of the SAS processors 210 as well as the communication processor 220. This initial loading may take place through a program/debug communication port. Further, the program codes stored in each of the SAS processors 210 and the communication processor 230 may be updated through commands and data sent from an external device, such as the bonus controller 40, through the communication processor 220 to the program/debug circuit 230. The program/debug circuit 230 then formats the updated program data for each of the connected SAS processors 210 and communication processor 220, and sends a command to each of the processors to be updated to load the new program code.

Figure 3B:
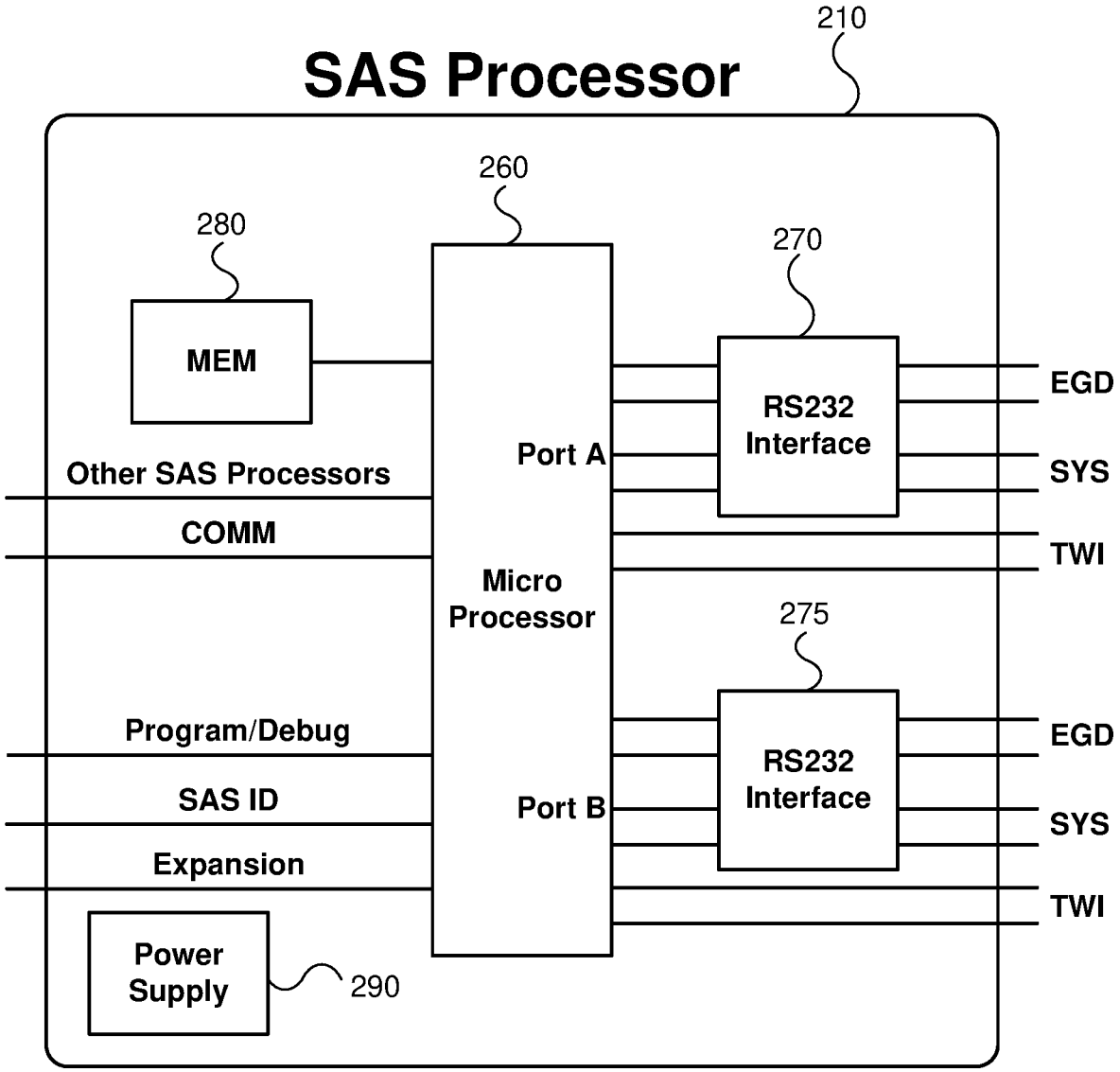
FIG. 3B is a block diagram of an example processor in the machine interface device illustrated in FIG. 3A according to embodiments of the invention.

FIG. 3B is a block diagram of one of the SAS processors 210 of FIG. 3A, which shows additional detail of the SAS processor.

As described above, each of the SAS processors 210 include two separate ports, Port A and Port B, illustrated here as separate ports of a microprocessor 260. The microprocessor 260 in the SAS processor 210 may be embodied by an Atmel ATXMEGA256A3, as described above.

Each of the ports of the microprocessor 260 is structured to couple to an EGD, which may be an EGM 10 of FIG. 1. Each port of the microprocessor 260 includes two serial connections, which in the example embodiment illustrated in FIG. 3B, are RS-232 ports common in the computing industry. The RS-232 ports are contained in an RS-232 interface 270, 275, one for each port of the microprocessor 260. Each of the interfaces 270, 275 includes two separate RS-232 ports, each of which uses a separate transmit and receive wire. Thus, each interface 270, 275 includes a total of four wires. It is convenient to include RS-232 ports as the preferred mode of communication because it is the standard interface for SAS ports of the EGMs 10. In non-standard EGMs 10, such as very old or future devices that may not include SAS ports, communication ports other than RS-232 may be used simply by exchanging or updating the RS-232 interfaces 270, 275. Another possibility is to include an RS-232 translator in any EGM 10 that does not include its own RS-232 interface. As illustrated in FIG. 3B, and as described above, the first of the serial connections, labeled EGD, is connected to an EGD for the particular port of the microprocessor 260, while the second serial connection, labeled SYS is connected to external devices that may be coupled to the particular EGD.

Additionally, and as described above, each SAS processor 210 includes two, two-wire interfaces, illustrated as a separate interface pair and labeled as TWI. In this embodiment, there is one pair for each port of the microprocessor 260. Each two-wire interface creates a bi-directional serial port that may be used for communicating with peripheral or expansion devices associated with the EGD of the particular microprocessor 260, or with other devices on the gaming system 2 of FIG. 1.

The SAS processor 210 includes a memory 280 for storing instruction data of the microprocessor 260 as well as providing data storage used by the SAS processor. The memory 280 is preferably non-volatile memory, such as FRAM that is connected to the microprocessor 260 through a serial interface.

As described above, the SAS processor 210 of the MIB 200 (FIG. 3A) includes multiple connections to other components in the MIB 200, which are illustrated in detail in FIG. 3B. Initially, each SAS processor 210 is coupled to each of the other SAS processors 210 in the MIB 200. In practice, this may accomplished by a direct connection, in which each microprocessor 260 is directly coupled to one another, or such connection may be an indirect connection. In an indirect connection, the microprocessors 260 of each SAS processor 210 is coupled to the communication processor 220 (FIG. 3A). Any data or information to be shared between SAS processors 210 is then originated by or passed through the communication processor 220 to the other SAS processors.

Similarly, as described above, the microprocessor 260 of each SAS processor 210 is coupled to a program/debug circuit 230 for initial or later programming.

To communicate with each SAS processor 210 individually, each SAS processor is given an individual identification number, which may be set for the microprocessor 260 by tying particular data pins of the microprocessor to permanent low or high signals. Using binary encoding, n individual lines are used to identify 2n separate processors.

A set of expansion pins couples to the microprocessor 260 of each SAS processor 210 so that each processor may determine system identification and revisions of the MIB 200 and the connected bonus controller 40.

Figure 4:
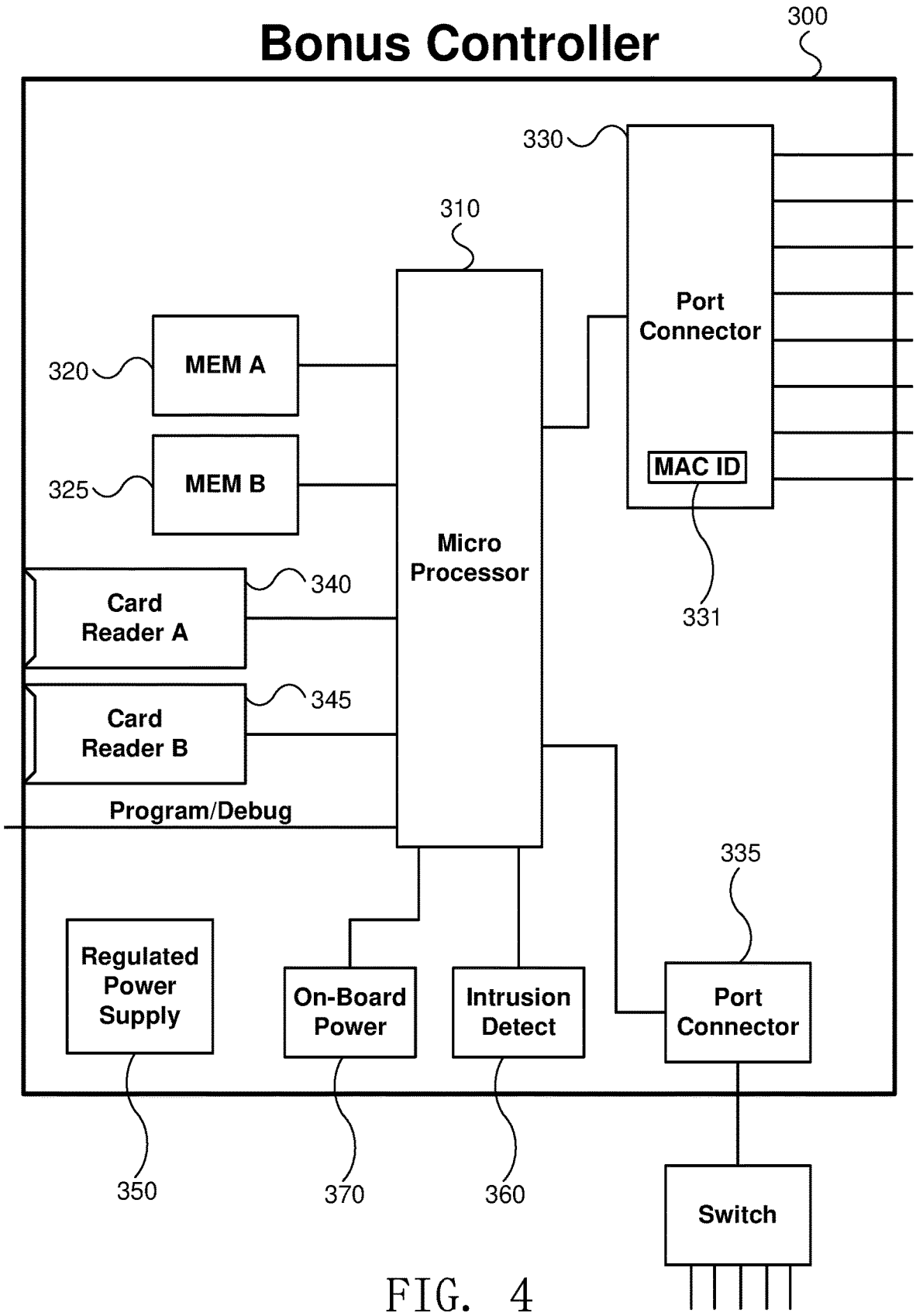
FIG. 4 is a block diagram of an example bonus controller shown in FIG. 1 according to embodiments of the invention.

With reference back to FIG. 1, recall that the bonus controller 40 couples to each of the MIDs 200, and by extension to their coupled EGDs, such as EGMs 10, and possibly to one or more EGMs themselves, to cause data and commands to be sent to the EGMs to control functions on each EGM. FIG. 4 is a detailed block diagram of such a bonus controller, according to embodiments of the invention.

A bonus controller 300 of FIG. 4 may be an embodiment of the bonus controller 40 illustrated in FIG. 1. Central to the bonus controller 300 is a microprocessor 310, which may be an Atmel AT91SAM9G20, which is readily available to developers.

The microprocessor 310 is coupled to one or more memory systems 320, 325. A memory system 320 is a 2 Megabyte FRAM while memory system 325 is a 64 Megabyte Synchronous DRAM (SDRAM). Each memory system 320, 325 has various advantages and properties and is chosen for those properties. FRAM maintains its data autonomously for up to ten years, while SDRAM is relatively fast to move data into and out of, as well as being relatively inexpensive. Of course, the sizes and types of memory included in any bonus controller according to embodiments of the invention may be determined by the particular implementation.

The microprocessor 310 also couples to a pair of card readers, 340, 345, which are structured to accept easily replaceable, portable memory cards, as are widely known. Each card reader may further include Electro-Static Discharge (ESD) devices to prevent damage to internal circuitry, such as the microprocessor 310, when cards are inserted or removed from the card readers 340, 345. In practice, a card in one of the card readers 340, 345 may store program code for the microprocessor 310 while a card in the other reader may store data for use by the bonus controller 300. Alternatively a single card in either of the card readers 340, 345 may store both program and data information.

A port connector 330 includes multiple communication ports for communicating with other devices. With reference back to FIG. 3A, the communication processor of each MID 200 couples to a connected bonus controller through such a communication port. The communication port 330 is preferably an Ethernet interface, as described above, and therefore additionally includes a MAC address 331. The port connector 330 includes multiple separate connectors, such as eight, each of which connect to a single MID 20 (FIG. 1), which in turn connects to up to eight separate EGMs 10. Thus, a single bonus controller 300 may couple to sixty-four separate EGMs by connecting through appropriately connected MIDs.

Further, a second port connector 335 may be included in the bonus controller 300. The second port connector may also be an Ethernet connector. The purpose of the second port connector 335 is to allow additionally connectivity to the bonus controller 300. In most embodiments the second port connector 335 may couple to another bonus controller 300 or to other server devices, such as the server 60 on the gaming network 50 of FIG. 1. In practice, the second port connector 335 may additionally be coupled to a MID 20, thus providing the bonus controller 300 with the ability to directly connect to nine MIDs 20.

Yet further, Ethernet connections are easily replicated with a switch, external to the bonus controller 300 itself, which may be used to greatly expand the number of devices to which the bonus controller 300 may connect.

Because the bonus controller 300 is intended to be present on a gaming network 50, and may be exposed to the general public, systems to protect the integrity of the bonus controller 300 are included. An intrusion detection circuit 360 signals the processor 310 if a cabinet or housing that contains the bonus controller 300 is breached, even if no power is supplied to the bonus controller 300. The intrusion detection circuit may include a magnetic switch that closes (or opens) when a breach occurs. The microprocessor 310 then generates a signal that may be detected on the gaming network 50 indicating that such a breach occurred, so that an appropriate response may be made. An on-board power circuit 370 may provide power to the bonus controller 300 for a relatively long time, such as a day or more, so that any data generated by the processor 310 is preserved and so that the processor 310 may continue to function, even when no external power is applied. The on-board power circuit 370 may include an energy-storing material such as a battery or a large and/or efficient capacitor.

Similar to the microprocessor processor 260 of the SAS processor 210 described above, the microprocessor 310 of the bonus controller 300 is additionally coupled to a program/debug port for initially programming the microprocessor 310 during production, and so that program and/or other data for the microprocessor may be updated through the program/debug port. In operation the bonus controller 300 configures and controls bonus features on gaming devices through a gaming network 50 or through other communication systems. Bonus features are implemented through each gaming device's internal structure and capabilities, and may include integration with additional peripheral devices. Bonusing programs for the connected games may be introduced to the bonus controller 300 by updating data stored in the memory systems directly on the bonus controller, or by inserting new memory cards in one or more of the card readers 340, 345. Such a platform provides a facility for game developers, even third-party developers, to define and program new types of bonus games that may be used in conjunction with existing EGMs on existing gaming networks, or on new games and new networks as they are developed.

As discussed above, one issue with conventional gaming devices and gaming systems is that they provide a limited number of paytables that are often difficult to generate while providing only a limited game play experiences. Embodiments of the present concept provide game insertion techniques to enhance the game play experience for players. These game insertion techniques include placing bonus spins, free games, or other incentives within traditional game play. For purposes of this application, a paytable used for determining a game outcome in the course of traditional game play will be referred to as a "base game paytable." The base game paytable includes both outcomes that are the result of what is generally considered part of the "base game," and also includes outcomes occurring from bonus games, jackpots, or progressive awards that may be awarded to a player during game play. The game enhancement means or bonus spins are not included in the base game paytable. Rather, they are mechanisms that are independent of the base game paytable.

In this application, the term "Bonus Spins" is used to refer to various game enhancing features not included in a base game paytable. Bonus spins may be used to reference any game enhancement that converts a losing outcome into a winning outcome. For example, bonus spins include free respins of game reels in a slot machine gaming device to convert an initial losing game outcome to a winning game outcome. However, bonus spins may also refer to draw card manipulation techniques that convert a losing video poker hand to a winning hand. Bonus spin bonuses are exciting to players and provide a tool for increasing effective payback percentage of base game paytables to compensate for various game or player conditions or parameters. Also, as used in this application, the term "Win Spin" (or "WinSpin") is used to refer to a bonus spin that results in a winning outcome. Similarly, the term "Free Spin" (or "FreeSpin") is used to refer to a bonus spin with an outcome that includes the possibility of a loss.

Bonus spin systems can be used for both traditional game play, where outcomes are randomly selected for each gaming event that is initiated, or for event list based gaming outcomes where multiple game outcomes are selected prior to receiving game initiating inputs that ultimately correspond to the selected game outcomes. Additional details about event list based gaming, and how bonus spins may be implemented and used in event list based gaming is discussed in co-pending application Ser. No. 12/981,048, entitled EVENT-BASED GAMING OPERATION FOR GAMING DEVICE. In either case, gaming machine operators want to configure overall payback % to match perceived marketing needs. It is difficult to alter weighted paytables and event list contents to account for the quantity and resolution of configuration options desired.

Bonus spins may also be used to modify the game play and ultimate payback percentage of a base game paytable. Weighted paytables may be similarly used as in conventional gaming devices, but fewer paytables may be required. If bonus spins are used to modify game play or a payback percentage, it may be preferable to begin with a paytable with a lower initial payback percentage, such as 90% payback. Note a loss insertion mechanism may be used to further reduce (or raise) a payback percentage. Loss insertions are discussed in detail in co-pending application Ser. No. 12/980,990, entitled MEANS FOR CONTROLLING PAYBACK PERCENTAGE OF GAMING DEVICE. Returning to bonus spins, at the start of each game, a bonus routine may be called along with a process to generate a game outcome. Based on the result of the bonus spin routine, a bonus spin may be associated with a selected game outcome. This bonus spin routine may have a single binary output of TRUE or FALSE based the selected game outcome and/or on selecting a bonus spin value either randomly or from specified table and comparing that value to predefined criterion. For example, the predefined criterion may be a single input called True %, which determines how often the bonus spin routine returns a TRUE outcome or a FALSE outcome. The bonus spin routine may also look at whether a selected game outcome is a losing game outcome (or the size of an award associated with an outcome), since the excitement of a bonus spin may be diminished if the initial spin is a sizeable win.

In one, a losing outcome that is selected as a game outcome is displayed along with an audio-video message or animation. Instead of an automatic respin, the player is given a free chance to spin again except that this free game's outcome is guaranteed to be a win. To make this clear, the "SPIN" button normally used to play the game may be reconfigured into a "WinSpin" button. In this alternative, the player is charged for the losing game—in other words the wager credit is deducted from the credit meter. But the next game—the bonus spin game—is played at the same bet size as the previous wager but the player is not charged for the game.

In various embodiments, bonus spins may be used seamlessly with traditional game play without notifying the player of the presence of a bonus spin. However, in other embodiments, the bonus spins may be treated as bonus-type events, but without the problems found in many conventional bonus systems. Traditionally bonuses have been offered primarily as an award of credits, which may be cashable or noncashable or as a multiplier of a game's normal award schedule. The reason and nature for such awards is traditionally communicated to players via the player tracking display. That creates problems because players are often so engrossed in game play that they do not see the player tracking display message. This is a problem because a player might walk away from an award she is entitled to. Just as importantly, if a casino pays an award to a player and the player doesn't realize it, there's no emotional gratification delivered. The casino effectively gives an amount of money to a player without getting any credit for the action. That's money poorly spent, as it does nothing to encourage a bond of loyalty between player and casino.

One technique is to perform bonus communication through a service window placed over the game screen. Since the player is already watching the game screen to monitor game outcomes, she is far more likely to see the message. Service windows may create problems though. First, the window through which bonus information is presented can be placed in a way that it interferes with the display of important game information. Second, the player doesn't always recognize what a text message means. Whether cause by inexperience, difficulty in reading a language or jus the feeling that such awards are rebates rather than winning experiences, the value of the award is often diminished by the manner in which it is presented.

In some embodiments, bonus spins are designed to overcome these problems by presenting bonus payments within the context of the gaming machine's pay table. For example, if a bonus of $5 is to be paid, and an existing base game outcome of BAR BAR BAR results in a payment of $5, the bonus system could simply cause the game to display BAR BAR BAR and pay the award. Most players already recognize BAR BAR BAR as a winning experience, which the bonus award indeed is. Also, this bonus spin would have no effect on the game's actual performance or its random number generated outcomes. No RNG outcome is ever predetermined or altered in any way. All bonuses paid are separately metered and accounted for—exactly as with traditional bonuses—thereby allowing exact and proper accounting of the base game's performance.

For example, rather than simply displaying a message saying "You won $5", these bonus spin embodiments present a notification of a bonus spin to the player gaming display of the gaming device. In these embodiments, the bonus spin notification may occur after the outcome of base game play is presented. For example, suppose a game ends with a CHERRY BLANK BLANK outcome, which is displayed to the player. After a couple of seconds an animation is played in which the game outcome display begins to shake and the word "WinSpin" appears. The shaken reels begin to spin again, just as in a normal game. The reels then stop and present a winning outcome that matches the bonus award value. In this example, the symbols BAR BAR BAR are displayed, which has an award value of $5.

The player perceives a free respin of the game that results in a winning outcome and instantly understands that she's won $5. Bonus spins can be configured to select a result from one or more winning outcomes of the base game, or in other embodiments, bonus outcomes not included in a base game paytable. When using the pays associated with winning outcomes in the base game paytable, the allowed award values for a bonus spin may include any one of, or all, of the base game award values. In this instance, a bonus is a bonus payment. However, in other embodiments, a bonus spin may also be programmed to result in both winning and losing outcomes, in which case the bonus spin award is akin to a free game.

As mentioned above, it is also possible to create outcomes other than base game outcomes. For example, a game could be programmed to show a base game paytable and additional bonus symbols, each with assigned award schedules. The bonus symbols would be clearly marked as bonus symbols that cannot be obtained by a base game outcome and are only paid when the external bonus engine dictates a bonus spin occurrence.

Uses for Bonus Spins

Bonus spins may be used in various manners to enhance the game play of gaming devices. Some of these uses are discussed in detail below, although other uses exist and may be implemented in other embodiments. The uses discussed below are wager size bonusing, loss abatement, loyalty bonusing, and player recognition uses.

Wager Size Bonusing

Casinos essentially charge an hourly fee for a chance to win money at their gambling machines. That fee is calculated as Wager Size×Hold %×Number of Games Played. A given game is designed for a specific hold % and game speed. Players that wager more pay a higher hourly fee but there is no reason for that fee to be completely proportional to wager size. A player who wagers 25 cents a game requires approximately the same amount of overhead and support as a player who wagers $10 per game. Higher wagers bring more hourly profit to casinos and it is often desirable to rebate some of those extra profits as bonus awards. Bonus spins may be awarded at different rates according to each wager size. However, to prevent any potential gains from a strategy of varying wager sizes, a separate WinSpin trigger value is selected for each bet size and bet sizes are accrued against that trigger value independently of the other bet sizes.

In one example, games being played at much higher wagers may be "enhanced" with bonus spins that raise the effective payback percentage (%) of the game above a normal payback percent. Casinos can afford to offer a higher payback percent to players making big wagers. These incentives are especially attractive if they provide a straightforward mechanism for the casino to implement, while being emotionally gratifying for players.

To illustrate one example of how bonus spins can be used, Tables 1, 2, and 3 are provided below. Here, Table 1 shows a base game paytable with seven winning symbol combinations that provide a 90% payback. Here, for a wager of 10 credits, the paytable specifies that a player can win between 5 and 1000 credits back, or receive no credits back with a losing outcome (XX XX XX).

TABLE 1

| PAYTABLE | PAY FOR A WAGER OF 10 |
|---|---|
| XX XX XX | 0 |
| XX XX CH | 5 |
| AB AB AB | 10 |
| 1B 1B 1B | 20 |
| 2B 2B 2B | 30 |
| 3B 3B 3B | 50 |
| 7 7 7 | 100 |
| JP JP JP | 1000 |
| AVG. PAY | 9 (90%) |

In Table 2, six wager amounts (wagers are shown as credits) are shown with a corresponding probability that a bonus spin occurs.

TABLE 2

| WAGER | BASE % | BONUS SPIN % | TOTAL % |
|---|---|---|---|
| 25 | 90% | 0.0 | 90.0% |
| 50 | 90% | 2.0 | 92.0% |
| 100 | 90% | 4.0 | 94.0% |
| 200 | 90% | 6.0 | 96.0% |

TABLE 2-continued

| WAGER | BASE % | BONUS SPIN % | TOTAL % |
|---|---|---|---|
| 500 | 90% | 7.0 | 97.0% |
| 1000 | 90% | 8.0 | 98.0% |

Here, each of the wager values uses the same base game paytable of 90% as shown above in Table 1. The bonus spins make it possible to offer each wager size a different effective payback percent. This provides an incentive to for players to play with higher wager amounts. The Bonus Spin % in this table designates the rate at which bonus spins are allotted. A 2.0% value, for example, adds one bonus spin for every 50 games (of that wager size) played. An 8% value, adds a bonus spin for every 12.5 games played (of that wager size).

In other embodiments, a bonus spin paytable may be provided that is separate from a base game paytable. The bonus spin paytable may take various player or game parameters into account. For example, Table 3, shown below, provides an example bonus spin paytable that increases the value of bonus spin percentage-wise as the wager size of the bet increases. Again, this may provide an incentive for a player to play at higher wager amounts.

TABLE 3

| | WAGER SIZE | | | |
|---|---|---|---|---|
| PAYTABLE | 10 | 50 | 100 | 500 |
| XX XX CH | 5 | 25 | 50 | 260 |
| AB AB AB | 10 | 50 | 100 | 550 |
| 1B 1B 1B | 20 | 100 | 200 | 1200 |
| 2B 2B 2B | 30 | 150 | 300 | 1700 |
| 3B 3B 3B | 50 | 250 | 500 | 3000 |
| 7 7 7 | 100 | 600 | 1200 | 7500 |
| JP JP JP | 1000 | 6000 | 13,000 | 100,000 |
| AVG. PAYS | 15 | 80 | 175 | 1000 |

Here, a bonus spin results in an average pay of 1.5 times an initial wager for a ten credit bet. However, the average pay increases as the wager size increases up to 2.0 times an initial wager for a 500 credit wager. For example, if each credit was equal to a penny, an average bonus spin would result in a 15 cent win for a ten credit bet while a $5.00 bet would receive an average bonus spin win of $10.00. These parameter variations may be fixed in specific bonus spin paytables (where multiple bonus spin paytables may exist) or may be calculated based on percent increases associated with each parameter step.

Loss Abatement

Players often become discouraged when too many losses occur in an uninterrupted sequence, a situation that is a natural occurrence of sequences of random selections. A bonus engine can issue a bonus spin whenever a player is deemed as having suffered too many losses, whether in sequence or in aggregate. For example, a gaming machine may have an average hit frequency of 25%. In other words, averaged over time, a player on this game should encounter a win on every fourth game played.

The hit frequency simply says there is 1 chance on 4 of striking a win on any given wager. If a loss occurs on a given play, the next game still has a 1 in 4 chance of striking a win. It is entirely possible that 7 or more losses may occur in a given sequence. At some point a player may become discouraged by a lengthy string of losses and quit playing. The gaming device or an external bonus controller could monitor the game's outcomes. If more than, for example, 10 losses occur in a row, the gaming device or bonus controller could provide a bonus spin event that will result in a winning outcome, thus mitigating the negative effect of such a losing streak.

Even though a player may not encounter a long streak of losses without wins, she may encounter a propensity of losses that are discouraging. For example, a player loses 8 times in a row, wins once, loses 8 more times, wins once again and then loses 7 more time. If this occurs on a game that is designed for a 25% hit frequency, the player may well be discouraged. One or more bonus spins could be provided to this player as well to mitigate the negative effect of a propensity of losses.

Loyalty Bonuses

WinSpins may be paid to players in return for loyalty. WinSpins may be awarded to players based upon total play volume, frequency of visits, duration of visits, total winnings, and other such metrics that encourage players to wager at a given casino more often.

Player Recognition Uses

Bonus spins may also be used to reward a player or group of players for special occasions (birthdays, parties, anniversaries), as a first time visitor to the casino, to customize a game experience to a player, or other purposes. For example, many players have different perceptions of gambling, including the minimum frequency at which they expect wins to occur or the minimum award size that they find gratifying. Bonus spins may be adaptable to individual player characteristics. For example, Player A is excited only by awards that exceed $50. Frequent awards of smaller value don't provide much satisfaction. Player B is gratified to win just $5 but does not like to endure long streaks of losing. WinSpin.

Often it is important that a player's first experience with a new game be impressive so that the player associates that game with a positive experience. One way to make a first experience impressive is a winning streak. In some embodiments, bonus spins may be tracked along with other parameters for each individual player. In these embodiments, additional bonus spins may be implemented for the first sets of games a player plays. For example, if a player chooses to play a new game type, a threshold level or other criteria used to determine bonus spins may be modified so that the first X games pay 110%. Since bonus spins are effectively bonus payments, the base game paytables of the gaming devices do not have to be modified. After an introductory period, the bonus spin threshold or criterion may be altered back to a less generous value. Additionally, the bonus spin threshold or criteria could be modified during a player's birthday or other events. In some embodiments, the rate of bonus spins awarded may be increased when a player's loyalty to a game or casino appears to be fading.

Implementation of Bonus Spins

Bonus spins may also be configurable by game, by casino and by player or by player categories in any combination. Bonus spin timing, frequency and value must be carefully choreographed to provide a gratifying player experience while protecting casino profits. In some embodiments, a configuration console is provided that allows a casino to configure bonus spin awards at a gaming device or at a bonus controller. Configuration may include consideration for player identity, award value, etc. in comparison with total play or relationship goals with a particular player.

In most cases, a budget is configured with careful consideration of total wagers made by a player and theoretical or actual win produced by the gaming machines the customer plays. Total bonus spin awards must normally be less than the actual win, although a casino may be willing to pay more than is won from the player when that player is considered to have good future potential as a long-term customer. Frequency of bonus spin awards is generally determined by a combination of average award size, theoretical win and the budget a casino wishes to apply to a given bonus award. Additionally, bonus spins for a specific use (such as Wager Size, Loss Abatement, Loyalty or Recognition purposes) may require configuration of several parameters before it begins operation.

The following are example parameters that may be addressed during implementation of bonus spins:

1. Funding Budget

This is usually expressed as a percentage of wagers made but may also include a separate budget source such as a fixed amount of money, a percentage of total revenue across the casino property, etc.

2. Eligible Recipients

This defines which players are to be given the award and under what circumstances. A Wager Size award could be made available to everyone, including identified and unidentified players. A Recognition award could be made available only to a select few players who meet stringent requirements. Eligibility could also be defined in tiers. For example, a Loss Abatement budget of 2% of wagers could be offered to players in one class, a budget of 3% to another class and 0% to yet another class.

3. Award Size

This defines the award amount and could be a fixed amount, say $20. Alternately, the award size may vary according to the perceived desires or value of a given category of players. For example, players within one class are given an award value of $10, while players in another class are given an average award of $5. Note that the award size does not necessarily override the award funding budget. If a budget is set to 2% of credits wagered, for example, a $10 award size would occur half as often as a $5 award size.

Another method of specifying award size is through a randomly selected amount from a weighted award table that results in a defined average award value. For example, a wager size bonus spin may be offered using a weighted bonus table that includes all possible pays offered by the game on which bonus spins are delivered. This bonus table may be weighted in a manner that parallels the game's own paytable (excluding loss possibilities) or weighted differently. The average weighted value of the bonus table represents the average cost of a bonus spin award.

For example, a bonus paytable has an average award of 2× the wager amount. If one bonus spin is paid for each 100 games wagered, the net bonus award is then equal to 2% of all wagers. Using this method it is easily possible to deliver any level of bonus desired.

In one example, suppose a base game provides a 90% payback percentage and each bonus spin awarded is worth $2. Further presume that an average player will wager 400 games per hour. As a reward for wagering larger amounts, bonus spins are awarded more frequently for larger wager sizes as follows in Table 4:

TABLE 4

| Wager Size | WinSpin Frequency | Bonus as % of Wagers | Games/ Hour | Hourly Bonus Award | Hourly Cost |
|---|---|---|---|---|---|
| 25 | 0.00% | 0.00% | 400 | 0 | $10 |
| 50 | 0.25% | 0.50% | 400 | 1 | $19 |
| 100 | 0.50% | 1.00% | 400 | 4 | $36 |

TABLE 4-continued

| Wager Size | WinSpin Frequency | Bonus as % of Wagers | Games/ Hour | Hourly Bonus Award | Hourly Cost |
|---|---|---|---|---|---|
| 200 | 1.00% | 2.00% | 400 | 16 | $64 |
| 500 | 2.00% | 4.00% | 400 | 80 | $120 |
| 1,000 | 3.00% | 6.00% | 400 | 240 | $160 |

In this example, no bonus spins are awarded for 25 cent play. Hourly cost to the player is 25 cents*400 games*10% hold−Hourly Bonus Award, or 25*400*0.1−0=$10.00. For 100 credit wagers, bonus spins are paid on 0.5% of all wagers. In other words, one bonus spin is awarded for every 200 games played. Since each bonus spin is worth 2× the wager amount, the total bonus value as a percentage of wagers is 1%. Hourly cost to the player is $1.00*400*0.1−$1.00*400*0.01=$40−$4=$36. For 1,000 credit wagers, the net hourly cost to players is $10*400*0.1−$10*400*0.06=$400−$240=$160, which is a $240 savings.

As mentioned above, a Free Spin is a bonus spin award with an outcome that includes the possibility of a loss. Free Spins provide excitement to players, as they are given another opportunity to win. Since some of the outcomes are losses though, the average award value is less. A Free Spin bonus can be implemented using a weighted paytable as just described for bonus spins that are Win Spins. However, the Free Spin weighted paytable includes an opportunity for loss. Depending on how often the loss outcome is allowed to occur in the weighted bonus paytable, the average award value of a Free Spin may be significantly less than that of a Win Spin. Thus, for a given bonus award budget, Free Spins could occur much more frequently than Win Spins when used as bonus spins.

4. Award Frequency & Placement

Bonus spin award frequency is a function of allotted budget and average award size. For illustration, let's consider another bonus spin award used with wager sizes. In this example, presume the budget is 2% of wagers. Hence, the base game's weighted paytable (excluding loss possibilities) may look like Table 5 below:

TABLE 5

| WIN PAY | | | |
|---|---|---|---|
| COMBO | PAY MULT | ODDS % | WEIGHTED |
| RED 7 | 100.00 | 0.13% | 0.130 |
| BLUE 7 | 20.00 | 0.75% | 0.150 |
| ORANGE 7 | 10.00 | 1.50% | 0.150 |
| ANY 7 | 5.00 | 5.90% | 0.295 |
| 3 BAR | 2.00 | 33.20% | 0.664 |
| 2 BAR | 0.60 | 30.80% | 0.185 |
| BAR | 0.40 | 18.71% | 0.075 |
| ANY BAR | 0.20 | 9.01% | 0.018 |
| | | 100.00% | 1.667 |

Here, the average weighted award is worth 1.667 times the wager size. With a budget of 2% of all wagers made and an average award of 1.667 times the wager size, award frequency is determined as 1/0.02*1.667=one award every 83.35 games.

The bonus engine could simply count games played (of a given wager size) and deliver a bonus whenever that count exceeded 83.35. (Although game counts must be accomplished in integer form, it is a simple process to alternate awarded between every 83rd game and every 84th game in order to achieve an overall average of 83.35.) Such a repetitive pattern would be quite boring and soon, players would no longer be surprised by the occurrence of a bonus spin.

In another embodiment, the bonus engine, upon every game play, randomly determines if a bonus spin is awarded. By setting the probability of an affirmative outcome at 1/83.35, the bonus spin award frequency is kept within a theoretical budget, although the awarding of bonus spins could exceed, or fall below, the expected budget over any given interval of wagers. That is because both the award value and the award frequency are now randomly determined and therefore could occur in a burst of awards in close proximity to one another, or be spaced out over larger intervals.

In another embodiment, which provides a more predicable frequency to the random determination above, a terminal value of 2*bonus spin rate −1 is calculated, where the bonus spin rate is 83.35. Here the resulting terminal value is 165.7, which is rounded up to 166. Next, an integer value between 1 and the calculated terminal value (in this case 166), is randomly selected. This selected value becomes the bonus spin trigger value. In one instance, suppose this value is 32. Here, the bonus spin award becomes available on the 32nd game played. Immediately after the bonus spin becomes available, a new random value is chosen from the same range as before and the process begins again.

To avoid players gaining an advantage through a bet size strategy on successive games, when a specific game count or a randomly selected game count between 1 and a terminal value, a separate count should be kept for each wager size. For example, if a player learned that a bonus spin was awarded after every 80th game played, she might make low value wagers for the first 79 games and then make a maximum value wager on the 80th game. The player would have a mathematical advantage if the award is a multiple of wager size, as is typical in many games. However, by maintaining a separate count for each wager size, the problem is avoided. In this same example, a player learns that a bonus spin seems to pay after every 80th game so she wagers 79 games at 25 cents and wagers the 80th game at $5. In this case, the 25 cent counter would reach 79 before the player switched wager sizes. But by playing the 80th wager at $5, the counter for $5 wager sizes is incremented and the 25 cent counter remains at 79 until she again returns to 25 cent wagers.

Bonus spin awards may be coordinated with normal game play to deliver a desired effect. For example, a bonus spin with only winning outcomes (or Win Spins) could be delivered only after a losing outcome. This implementation has the effect of turning a losing wager into a winning one. In another implementation, a Win Spin is awarded only after a winning outcome on the base game. In this case, the Win Spin is a bonus paid in addition to the base game win.

In yet another implementation, a bonus spin with both winning and losing outcomes (or Free Spin) could be delivered after a win, after a loss only, or after any outcome on the base game, effectively providing a second chance to win, without a guarantee of winning. Bonus spins can also be placed only after winning events that occur on the base game and which meet a specific size requirement. For example, a bonus spin may be provided only upon a game outcome with a value of less than 2× the wager amount. In another example, a bonus spin may be awarded only when the base game outcome has a value of greater than 4× the wager amount.

When bonus spin awards are limited to placement only following specific base game outcomes (such as only after a win or only after a loss), the award payment may be delayed past when it should have been theoretically paid according to award budget and award frequency. For example, a bonus spin is configured for payment after every 40th game, but is also configured to only be awarded after a losing outcome. If the 40th game is a winning outcome, the bonus spin is not implemented. Instead, it is held until the next losing outcome and then paid.

Continuing the above example, if a loss did not occur until game 42, the bonus spin would not be awarded until after game 42. But since the award frequency should be every 40th game, a new award counter may be started after the conclusion of the 40th game to determine when the next bonus spin is to be awarded, even though the current bonus spin has not yet been issued. In this case, the first bonus spin is paid after game 42 and the second bonus spin is available for payment upon the first loss that occurs upon, or after, the 80th game.

In another implementation, a player's win frequency is increased by adding bonus spins for a period of time and/or skipping over LOSS outcomes received without charging the player for the game. These techniques are useful for temporarily converting standard games into tournament games. In tournaments, a player is typically given a fixed number of games, or a fixed duration of play, during which the player accumulates as many credits as possible. These credits are not allowed to be cashed out and are good for no purpose other than establishing a score that is compared against other players. The highest scores usually win cash prizes. One limitation for using traditional gaming devices as tournament games is the difficulty in changing out the pay tables of the game for the brief time a tournament lasts.

In one embodiment the bonus spin routine is created through software running on a computer such as a microprocessor. In another embodiment the bonus spin routine may be implemented in discrete logic, built using programmable logic or through other means. For purposes of this application, the bonus spin routine may include any mechanism in a game device or game system that allows for some control of typical game events. In some embodiments, the bonus spin routine may be directly implemented in the gaming device to control the payback percent on that gaming device. In other embodiments, the bonus spin routine may be implemented into a bonus controller (such as the bonus controller 40 shown in FIG. 1) or other peripheral device connected to the gaming device that allows control over aspects of game play. In yet other embodiments, the bonus spin routine may be implemented on a remote server that has at least some control over game play on a connected gaming device.

There are many advantages to implementing bonus spins on an external bonus controller or server that is interconnected with a number of gaming machines (such as shown in FIG. 1). In such a configuration, a player may be monitored as she plays on different games and bonuses may be paid in response to the totality of wagers. However, some casinos may not have implemented an external bonus controller or server but still wish to provide bonus awards such as bonus spins. All of the above described bonuses may be awarded to players using logic built into the gaming machine itself.

In conventional gaming devices, i.e., those not programmed to include bonus spin animations, a remote bonus controller or server may be used to control bonus spins on the gaming device. These gaming devices may include either (or both) video and mechanical spinning reel implementations. In these cases, the bonus spin notification message may be communicated through a display separate from the base game display. This could be on a display attached specifically to communicate bonus spin awards, on a display included with the player tracking functions, or another display.

If the game is equipped with a two-way communications protocol such as the SAS or GSA protocols (which are well known in the gaming industry) the bonus controller can still detect base game occurrences and outcomes and cause payments of specific awards to be made through the base game's credit meter or other payout mechanism. Here, the bonus spin game could be carried out on the separate display, or alternately, it could use the game display of the gaming device to implement the bonus spin. Where the gaming device has a winning outcome on the base game, the bonus spin award could be modified from a traditional replay of a part of the gaming event. For example, if the base game award was BAR BAR BAR which paid $5, an award equal to that amount ($5) could be paid as a bonus spin.

Here, a message may appear on the separate display saying "Your jackpot has been doubled." Similarly, the base game award could be multiplied by another amount such as 3× (triple jackpot) or 4× (quadruple jackpot). Awards equal to a fraction of the base game award are also possible, such as 50% bonus (paying $2.50 on top of the example's $5 base award).

The bonus controller could also force a respin of the base game, either as a result of a command sent to the game's information port configured for such a purpose or by adding credits and causing the activation of the game's "Play" button (or "Spin" button). In this case, the award could be whatever the base game selected (including losing outcomes) or, if the game is capable of receiving it, the bonus controller could send a command telling the base game at what outcome to stop.

It may be preferable to accumulate bonus win awards in a credit meter or other mechanism that is separate from the gaming device. In this way, additional rights or limits may be attached to the bonus wins. For example, bonus wins may only become usable to pay for additional base game play after a player spends a certain amount of money playing a base game. Or the accumulated amount could become useful only on a future visit. The bonus win amount may also be increased beyond actual bonus amounts won on player birthdays, etc. By keeping a separate accounting of bonus wins, these and many other such additional rights or limits can be expressed.

Regardless of implementation, the bonus spin award may still be accounted for as a bonus award and not as part of the base game award. However, in other embodiments, if the base game is caused to respin and stop at an outcome selected in the same way as all other base game outcomes are selected, any resulting award could be accounted for as a base game payment, so long as the bonus engine also sends the appropriate wager amount to the base game. Various examples of bonus spins will now be discussed with reference to the drawings.

Figure 5A:
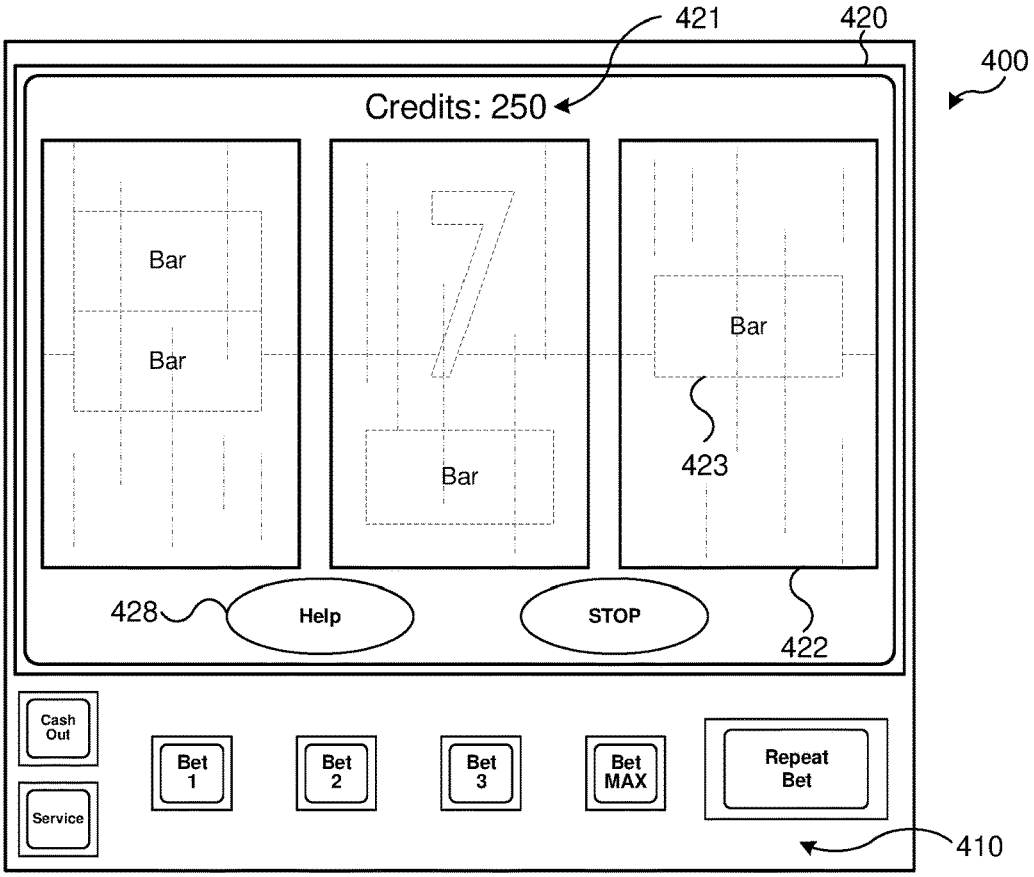
FIGS. 5A, 5B, and 5C are detail diagrams of a game display showing a gaming session progression with enhanced game play according to embodiments of the invention.
Figure 5B:
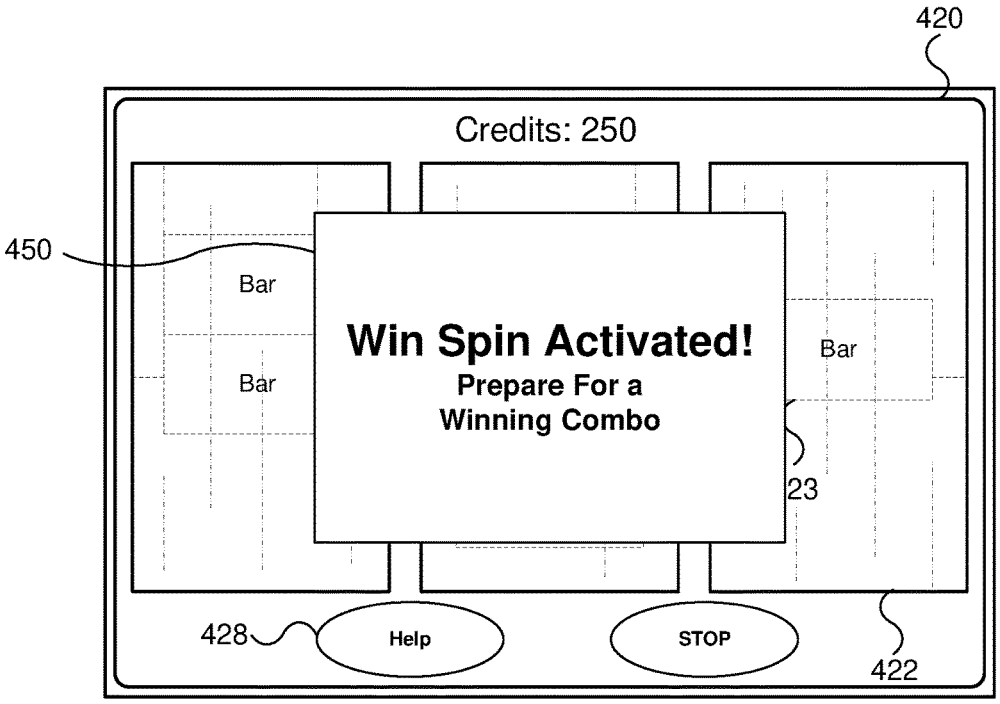
Figure 5C:
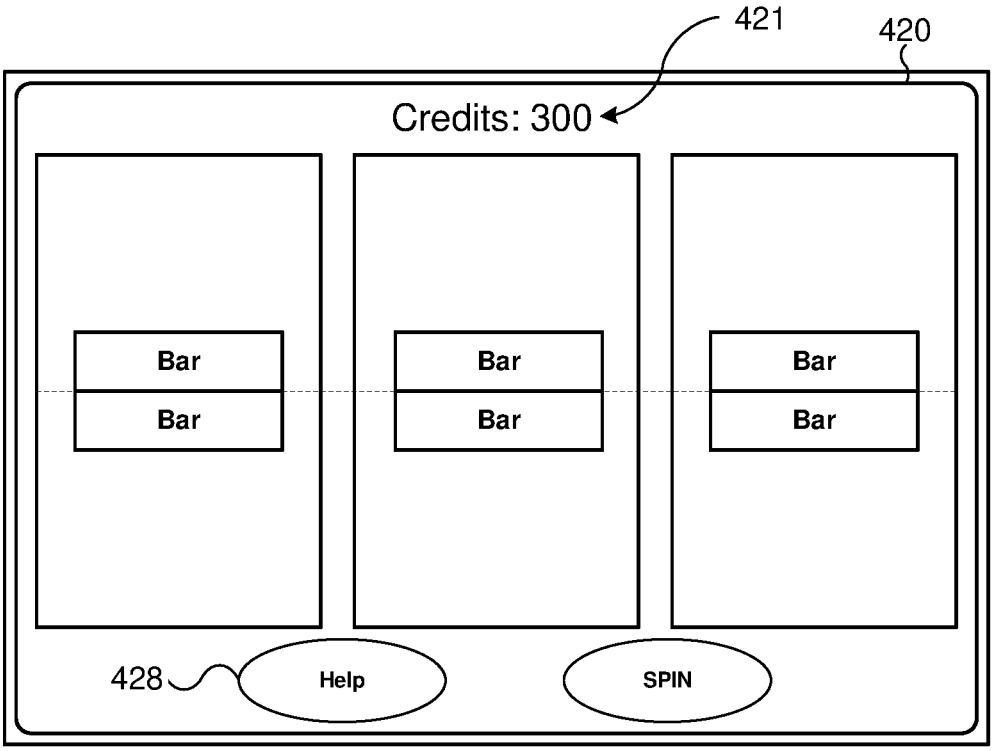

FIGS. 5A, 5B, and 5C are detail diagrams of a game display showing a gaming session progression with enhanced game play according to embodiments of the invention.

Referring to FIG. 5A, a gaming device 400 includes a player interface portion 410 and a gaming display 420. The gaming display includes a credit meter 421, three game reels 422 having a number of game symbols 423, and one or more game buttons 428. In FIG. 5A, a wager has been placed on the gaming device 400, and a gaming event has been initiated using the player interface panel or game buttons 428 on the game display 420. The game reels 422 are shown to all be spinning as a result of the gaming event initiation. In this embodiment, the game display 420 is a video display depicting the three game reels in a video format. However, in other embodiments, the reels may be mechanical reels on a game display.

Referring to FIG. 5B, as the game reels 422 are spinning, a notification 450 appears on the game display 420 indicating to the player that a bonus spin (here, called a "Win Spin") has been awarded. This notification 450 may be accompanied by various sounds or visual cues to emphasize the bonus spin event. Providing notification 450 of the bonus spin may help a player differentiate a special event versus just another game outcome, as well as build excitement and anticipation. When the player observes the notification 450, the player may realize that they will be receiving winning game outcome. The only remaining question is how large the award will be for the winning game outcome. In embodiments where mechanical reels are used on game display, the notification may be shown on secondary display (e.g., secondary display 180 in FIG. 2) or otherwise communicated to the player with lights, visual aids, and/or sounds.

Referring to FIG. 5C, the reels 422 have come to a stop in the bonus spin and now display that the player has received a winning combination of double bar symbols. Additionally, the credit meter 421 is incremented with the award associated with the winning outcome.

FIGS. 6A, 6B, 6C, and 6D are detail diagrams of a game display showing another gaming session progression with enhanced game play according to embodiments of the invention.

Figure 6A:
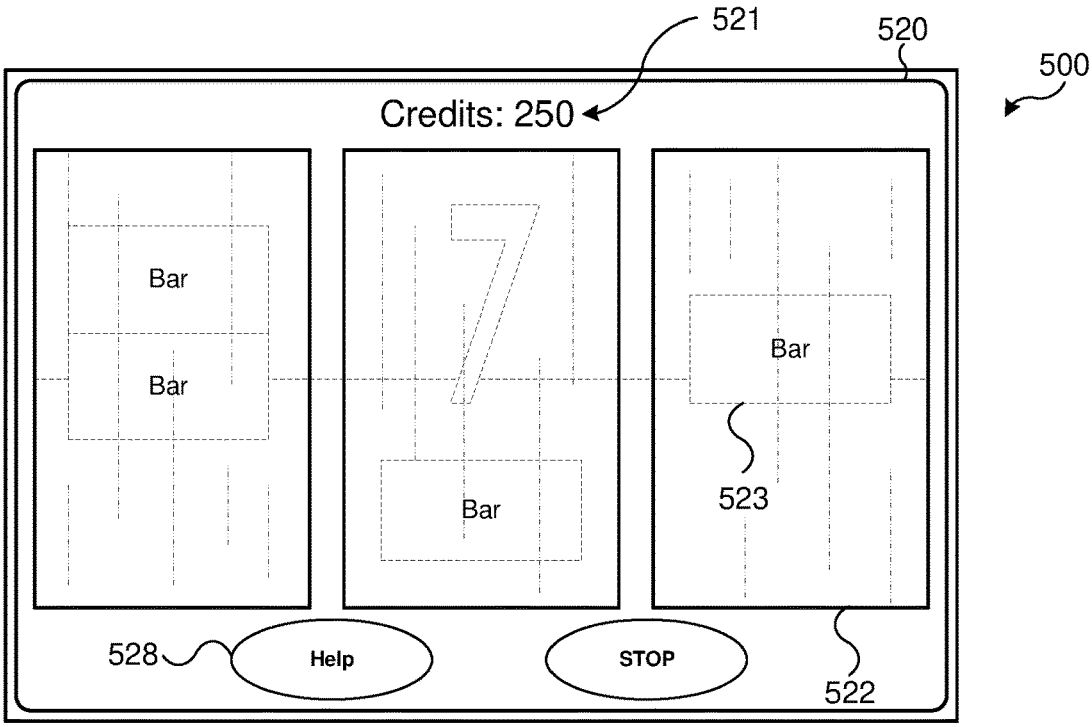
FIGS. 6A, 6B, 6C, and 6D are detail diagrams of a game display showing another gaming session progression with enhanced game play according to embodiments of the invention.

Referring to FIG. 6A, a gaming device 500 includes gaming display 520 having a credit meter 521, a number of game reels 522 with game symbols 523, and one or more game buttons 528. Similar to FIG. 5A, a wager has been placed on the gaming device 500, and a gaming event has been initiated using a player interface panel (not shown) or game buttons 528 on the game display 520. The game reels 522 are shown to all be spinning as a result of the gaming event initiation. In this embodiment, the game display 520 is again a video display depicting the three game reels in a video format. However, in other embodiments, the reels may be mechanical reels on a game display.

Figure 6B:
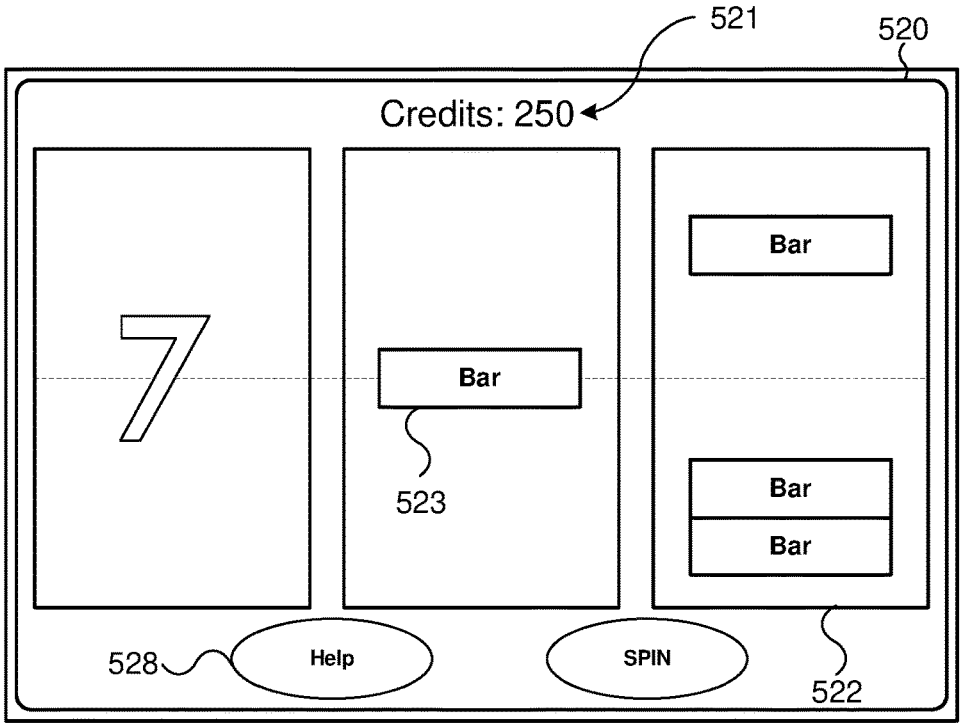

Referring to FIG. 6B, the game reels are stopped to show a preliminary game outcome. Here, the preliminary game outcome is a losing outcome that does not have any awards associated with the received symbol combination.

Figure 6C:
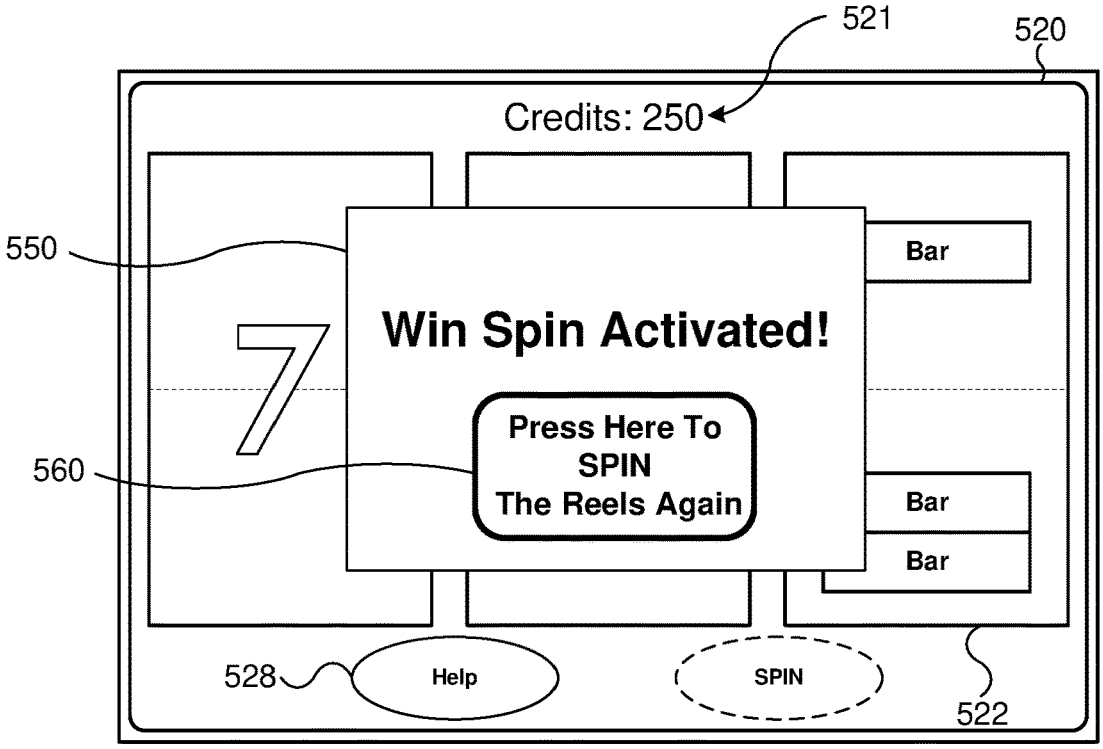

Referring to FIG. 6C, after the preliminary game outcome is displayed, a bonus spin notification is displayed on the game display 520. In this embodiment, the notification includes a button for the player to press to trigger a respin of the reels. In some embodiments, the notification may not include a respin activation button 560. Rather, in these embodiments, the reels may respin after the preliminary game outcome and/or notification has been displayed for a predefined period of time. For example, the preliminary outcome may be displayed for 1.5 seconds before the notification 550 appears. Then the notification may remain on the game display 520 for 4 seconds before the reels are respun. In some embodiments, the notification may be positioned so that it does not cover the reels 522 significantly to hide the preliminary game outcome.

In the embodiment shown in FIG. 6C, the respin activation button 560 is associated with the notification 550. However, in other embodiments, the player may be directed to press one of the physical buttons on a player interface panel (410 FIG. 5A) or a game button 528 on the gaming display 528. In some embodiments, if the player does not press the respin activation button 560 within a predefined time limit, the game reels 522 are automatically respun.

Figure 6D:
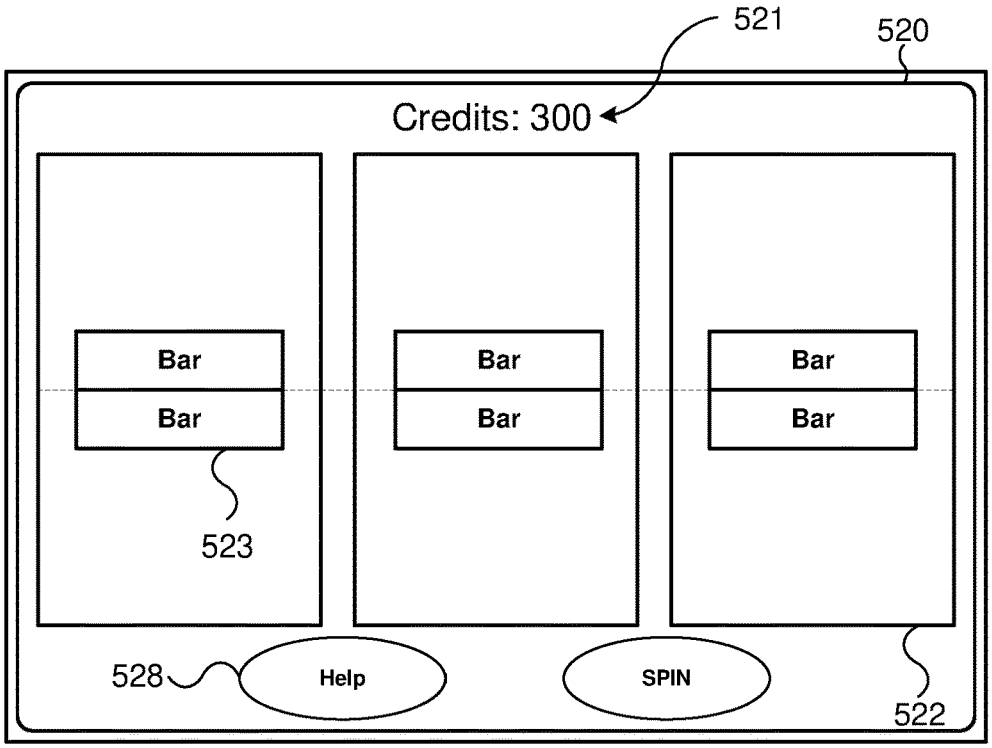

Referring to FIG. 6D, the reels 522 have been respun and have come to a stop in the bonus spin. The reels 522 now show that the player has received a winning combination of double bar symbols. Additionally, the credit meter 521 is incremented with the award associated with the winning outcome.

Figure 7:
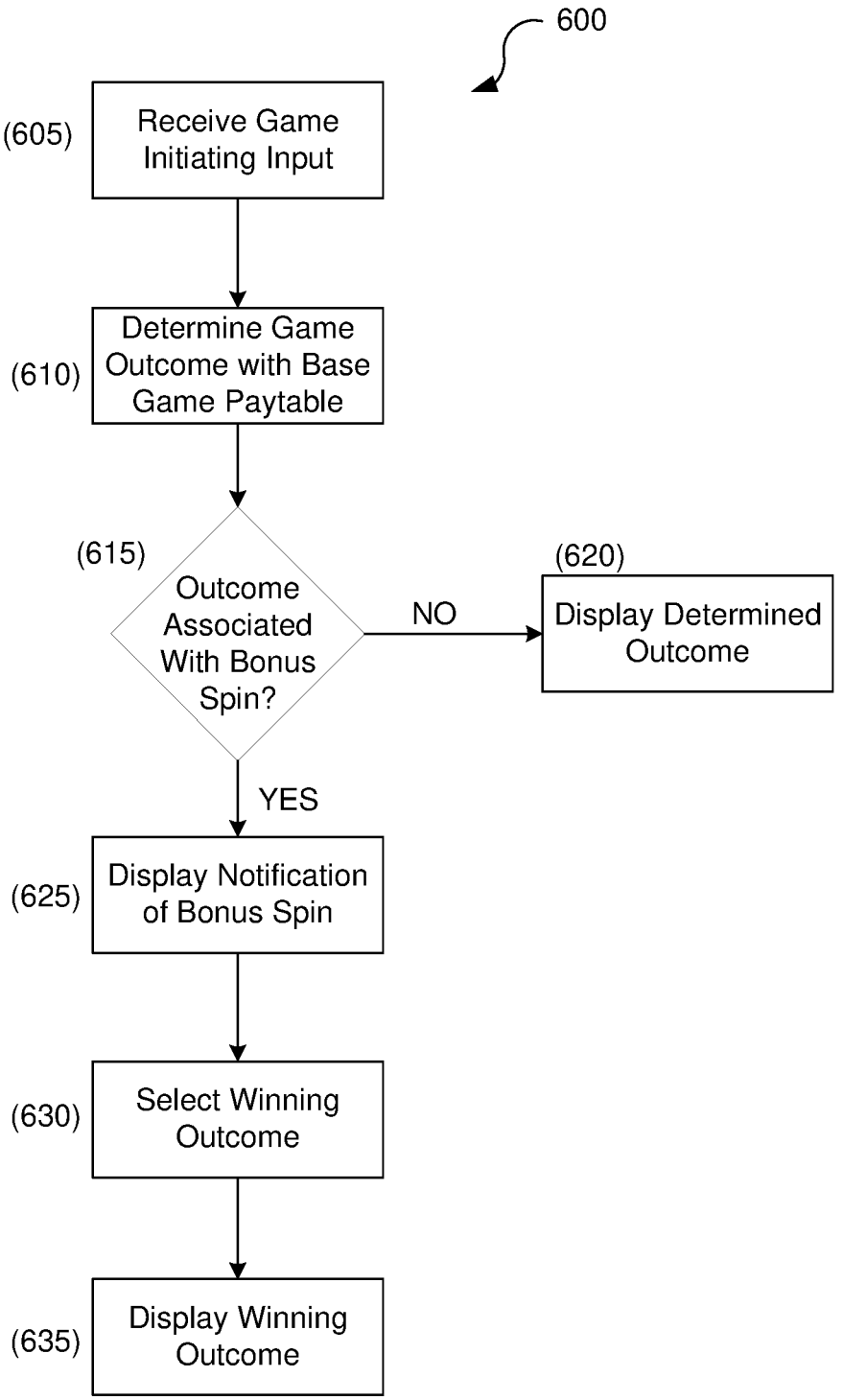
FIG. 7 is a flow diagram of a method of operating a game device with enhanced game play according to embodiments of the invention.

FIG. 7 is a flow diagram of a method of operating a game device with enhanced game play according to embodiments of the invention.

Referring to FIG. 7, flow 600 begins with process 605 where a game initiating input is received. After the game initiating input is received in process 605, flow 600 proceeds to process 610 where a game outcome is determined from a base game paytable. In process 615 it is ascertained whether the determined game outcome is associated with a bonus spin. As mentioned above, a bonus spin can refer to any game progression that proceeds from a determined game outcome to a winning outcome. When a determined game outcome is not associated with a bonus spin as ascertained in process 615, flow 600 proceeds to process 620 where the determined game outcome is displayed on a game display. This process may include displaying intermediate game action or game steps, such as the spinning and stopping of mechanical or video reels, providing a player the option of holding and drawing cards in video poker, or otherwise displaying portions of game play prior to the display of the ultimate game outcome. If any prizes are associated with the game outcome, they are awarded to the player.

On the other hand, when a determined game outcome is associated with a bonus spin as ascertained in process 615, flow 600 proceeds to process 625 where a bonus spin routine is initiated. In process 625 a notification is displayed to the player to inform that player that bonus spin has been awarded. Next, in process 630, a winning outcome is selected. As discussed above, this winning outcome may be selected from a separate bonus spin paytable. After a winning outcome is selected, the winning outcome is displayed on the game display in process 635 and a prize associated with the winning outcome is awarded to the player.

In some embodiments, process 615, where it is ascertained whether the determined game outcome is associated with a bonus spin includes the step of determining whether a game outcome is a losing game outcome. If the determined game outcome is a winning game outcome, process 615 indicates that the game outcome is not associated with a bonus spin and proceeds to process 620 to display the determined game outcome. This step eliminates the use of bonus spin when a determined outcome is already a winning outcome. In other embodiments, however, the player may receive prizes from both a determined game outcome when it is a winning outcome and a bonus spin outcome when a bonus spin is associated with a game outcome that is a winning game outcome. In yet other embodiments, the player may receive the larger of the two prizes from the determined game outcome and bonus spin outcome. In other embodiments, the bonus spin outcome may simply supersede and replace any determined outcome when it is associated with the game outcome.

In some embodiments, process 615, where it is ascertained whether the determined game outcome is associated with a bonus spin includes the step of selecting a bonus spin value from a predefined table. If the selected bonus spin value does not meet a predefined criterion, process 615 indicates that the game outcome is not associated with a bonus spin and proceeds to process 620 to display the determined game outcome. Here, the bonus spin value may be selected at random or may be weighted based on one or more player or game conditions/parameters as discussed above. If the bonus spin value does meet the predefined criterion, a bonus spin may be associated with the determined game outcome.

As shown above in FIG. 6C, the bonus spin routine may also include displaying the determined game outcome prior to displaying the notification to the player that a bonus spin has been awarded. In flow 600, this additional step may be included in process 625 prior to displaying the notification of the bonus spin to the player.

Figure 8:
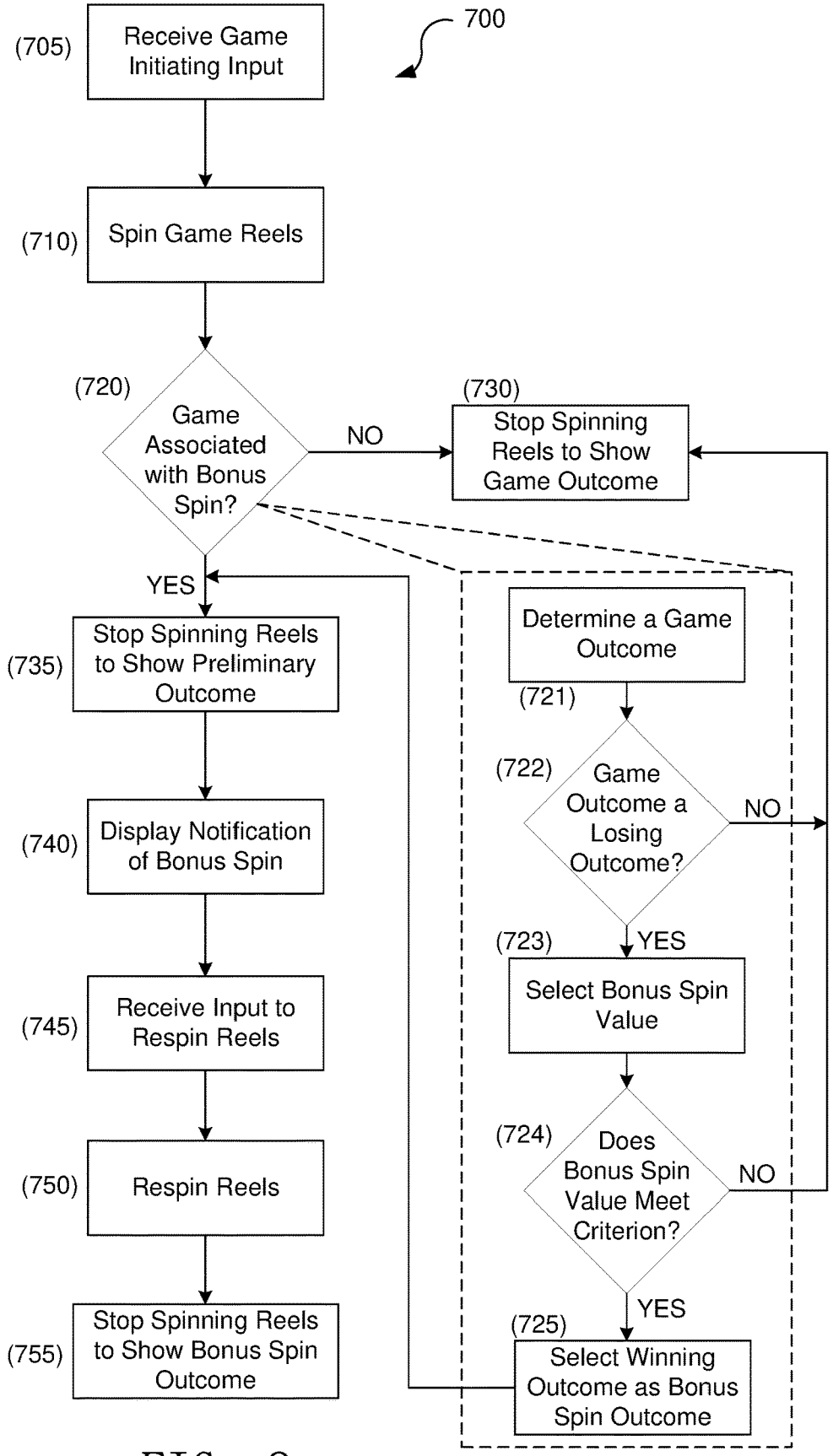
FIG. 8 is a flow diagram of another method of operating a game device with enhanced game play according to embodiments of the invention.

FIG. 8 is a flow diagram of a method of operating a spinning reel game device with enhanced game play according to embodiments of the invention.

Referring to FIG. 8, flow 700 begins with process 705 where a game initiating input is received. After the game initiating input is received in process 705, flow 700 proceeds to process 710 where a slot machine game reels are spun. The game reels may be similar to the reels shown in FIG. 5A, and may be mechanical reels or reels that are implemented on a video display. In process 720, it is determined whether a bonus spin is associated with the gaming event (or game). An example progression of steps is shown in the dashed box linked to the decision block for process 720 in FIG. 8. This progression of steps is how process 720 may be carried out in one embodiment. However, other embodiments may use other steps in determining if a bonus spin is associated with a game.

Here, the example step progression for process 720 shown in the dashed box includes determining a game outcome in process 721, and ascertaining whether the determined game outcome is a losing game outcome in process 722. If the determined game outcome is found to be a winning game outcome, flow 700 proceeds to process 730 where the reels are stopped to show the determined game outcome. If the determined game outcome is found to be a losing game outcome in process 722, flow 700 then proceeds to process 723 where a bonus spin value is selected. The selected bonus spin value is then compared to a predefined criterion in process 724. The selection of the bonus spin values and various predefined criteria are discussed above. If the selected bonus spin value does not meet the predefined criteria, flow 700 again proceeds to process 730 where the reels are stopped to show the determined game outcome. If, on the other hand, selected bonus spin value does meet the predefined criteria, flow 700 then proceeds to process 735 where a bonus spin routine is initiated. Here, the spinning reels are stopped in process 735 to show a preliminary outcome. A notification that a bonus spin has been awarded is displayed to a player in process 740.

An input is then received in process 745 to respin the reels. In some embodiments the player is asked to hit a button or otherwise make an input to trigger the respinning of the reels (see, for example, FIG. 6C). This ensures that a player has noticed that a bonus spin has been awarded and may provide more excitement to the player as they get to trigger the respin. In other embodiments, the input received may be a signal indicating that the preliminary outcome has been displayed for a predetermined amount of time. In other words, the reels are automatically respun after the preliminary outcome is displayed for a particular amount of time. Once the input is received to respin the reels, the reels are spun again in process 750 and stopped in process 755 to display the bonus spin outcome.

Figure 9:
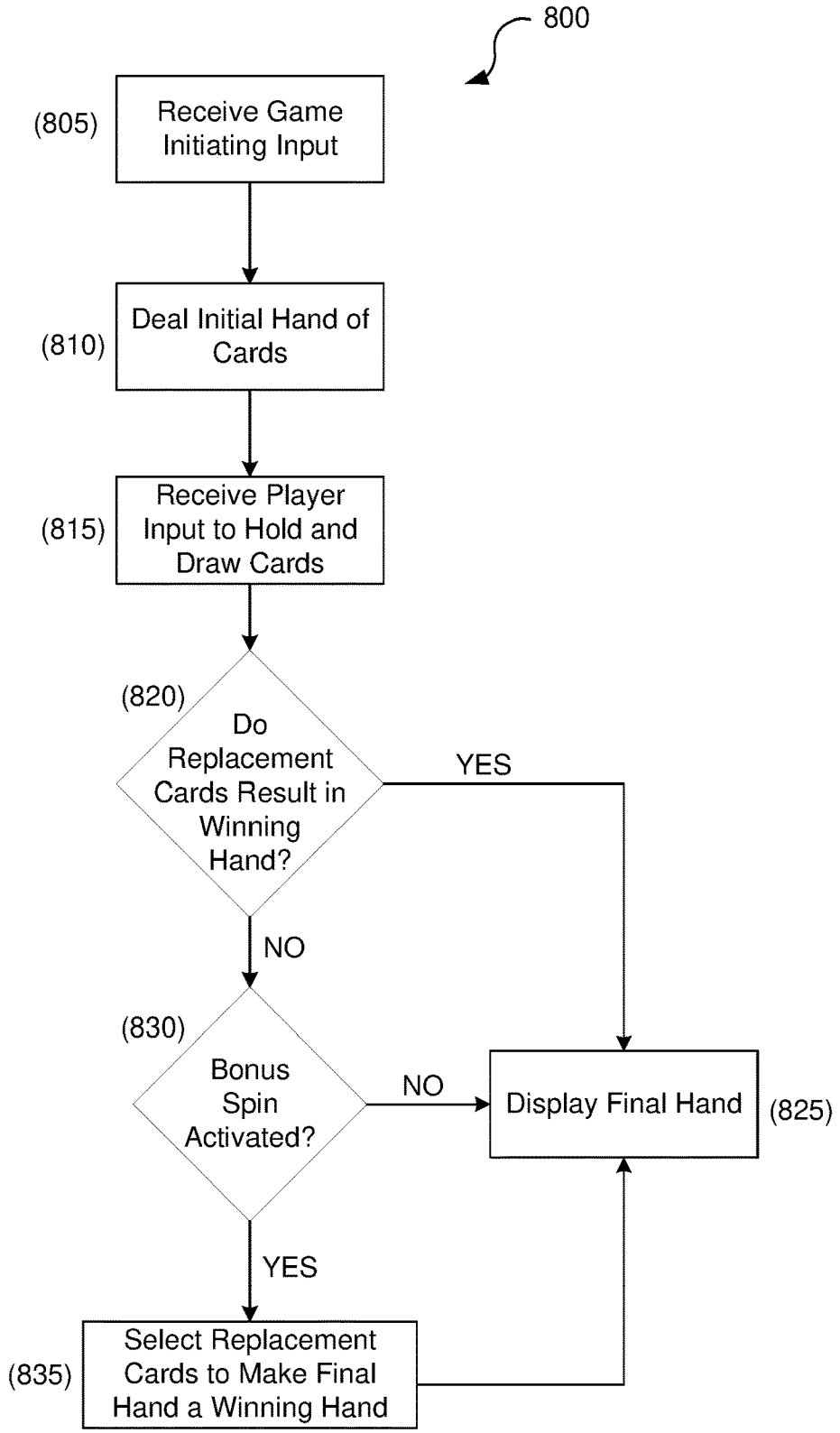
FIG. 9 is a flow diagram of yet another method of operating a game device with enhanced game play according to embodiments of the invention.

FIG. 9 is a flow diagram of a method of operating a video poker game device with enhanced game play according to embodiments of the invention.

Referring to FIG. 9, flow 800 begins with process 805 where a game initiating input is received. After the game initiating input is received in process 805, flow 800 proceeds to process 10 where an initial hand of cards is dealt to a player. In many video poker games, the player is initially dealt five cards. In process 815, player inputs are received to hold cards and draw new cards for non-held cards. For example, if a player holds two cards and presses a draw button, three new cards are drawn to complete a final hand. Here, prior to displaying the new draw or replacement cards, it is determined whether the selected replacement cards result in a winning hand in process 820. If the final hand with the draw cards results in a winning final hand, flow 800 proceeds to process 825 where the final hand is displayed. In instances where the player is dealt an initial hand with a winning card combination, flow 800 may skip process 820 and move directly to process 825 to display a final hand.

If the final hand with the draw cards does not result in a winning final hand, flow 800 proceeds from process 820 to process 830 where it is determined whether a bonus spin has been activated. If a bonus spin has not been activated, flow 800 again proceeds to process 825 to display the final hand. If, however, a bonus spin has been activated, flow 800 proceeds to process 835 where new draw or replacement cards are selected to make a final hand with a winning card combination.

Some embodiments of the invention have been described above, and in addition, some specific details are shown for purposes of illustrating the inventive principles. However, numerous other arrangements may be devised in accordance with the inventive principles of this patent disclosure. Further, well known processes have not been described in detail in order not to obscure the invention. Thus, while the invention is described in conjunction with the specific embodiments illustrated in the drawings, it is not limited to these embodiments or drawings. Rather, the invention is intended to cover alternatives, modifications, and equivalents that come within the scope and spirit of the inventive principles set out in the appended claims.

The invention claimed is:

1. A gaming device having a plurality of randomly determined base-game outcomes comprising predetermined combinations of base-game symbols that are displayed to a player of the gaming device, at least one of the predetermined combinations being associated with a winning base-game outcome and at least one of the predetermined combinations being associated with a losing base-game outcome, the gaming device comprising:

a device configured to interact the player to apply a monetary value to the gaming device, the monetary value establishing a credit balance that is decreasable based on at least wagering activity;

a bet input device that receives a bet based on the credit balance responsive to actuation of the bet input device;

an actuator for initiating a gaming event;

a display for displaying images related to game play, including the base-game symbols;

a cash-out device operative to cause an initiation of a payout associated with the credit balance;

at least one computing processor configured to execute computer readable program code to implement a method comprising:

ascertaining independently of a base-game outcome if each of at least some of the gaming events is associated with a bonus;

permitting display of one of the randomly determined base-game outcomes when the gaming event is not associated with a bonus;

when the gaming event is associated with a bonus:

displaying a losing outcome comprising a combination of symbols selected from the base-game symbols that comprises a losing base-game outcome, displaying a notification to the player that a bonus has been awarded, receiving an input to the actuator for initiating a gaming event, displaying an outcome comprising a combination of symbols selected from the base-game symbols that comprises a winning base-game outcome, and awarding a prize associated with the winning base-game outcome.

2. The gaming device of claim 1, wherein receiving an input to the actuator includes receiving an input from a player.

3. The gaming device of claim 1, wherein the at least one processor is further configured to execute computer readable program code to display the losing game outcome for a predefined period of time.

4. The gaming device of claim 1, wherein ascertaining independently of the base-game outcome if each gaming event is associated with a bonus further includes:

selecting a bonus value; and ascertaining that the gaming event is not associated with a bonus when the selected bonus value does not meet a predefined criterion.

5. The gaming device of claim 4, wherein the method implemented by the at least one processor further comprises indicating to a player of the gaming device that the gaming event is associated with a bonus when the base-game outcome is a losing base-game outcome and when the selected bonus value meets the predefined criterion.

6. The gaming device of claim 1 wherein the symbols appear on reels that spin.

7. The gaming device of claim 1 wherein the symbols appear on images of playing cards.

8. A gaming system comprising:

a plurality of gaming devices each having:

a plurality of randomly determined base-game outcomes comprising predetermined combinations of base-game symbols that are displayed to a player of the gaming device, at least one of the predetermined combinations being associated with a winning base-game outcome and at least one of the predetermined combinations being associated with a losing base-game outcome;

a bet input device that receives a bet based on a credit balance responsive to actuation of the bet input device;

an actuator for initiating a game;

a display for displaying images related to game play;

a cash-out device operative to cause an initiation of a payout associated with the credit balance;

a network interconnecting the gaming devices; and a bonus controller connected to the gaming devices via the network, the bonus controller including at least one computing processor configured to execute computer readable program code to implement a method comprising:

ascertaining independently of the base-game outcome if each of at least some of the gaming events is associated with a bonus;

permitting display of one of the randomly determined outcomes when the gaming event is not associated with a bonus;

when the gaming event is associated with a bonus:

displaying a losing outcome comprising a combination of symbols selected from the base-game symbols that comprises a losing base-game outcome, displaying a notification to the player that a bonus has been awarded, receiving an input to the actuator for initiating a gaming event, displaying an outcome comprising a combination of symbols selected from the base-game symbols that comprises a winning base-game outcome, and awarding a prize associated with the winning base-game outcome.

9. The gaming device of claim 8, wherein receiving an input to the actuator for initiating a game event includes receiving an input from a player.

10. The gaming device of claim 8, wherein the method implemented by the at least one processor further comprises displaying the losing game outcome for a predefined period of time.

11. The gaming device of claim 8, wherein ascertaining independently of the base-game outcome if each of at least some of the gaming events is associated with a bonus further includes:

selecting a bonus value; and ascertaining that the gaming event is not associated with a bonus when the selected bonus value does not meet a predefined criterion.

12. The gaming device of claim 11, wherein the method implemented by the at least one processor further comprises indicating to a player of the gaming device that the gaming event is associated with a bonus when the base game-outcome is a losing game outcome and when the selected bonus value meets the predefined criterion.

13. The gaming device of claim 8 wherein the symbols appear on reels that spin.

14. The gaming device of claim 8 wherein the symbols appear on images of playing cards.

15. A non-transitory computer readable medium that stores a plurality of instructions, which when executed by at least one processor, cause the at least one processor to:

monitor a plurality of at least some gaming events, each of which comprises a plurality of randomly determined symbols;

ascertain independently of each base-game outcome if each of a plurality of gaming events is associated with a bonus;

permit display one of the randomly-determined base game outcomes when the gaming event is not associated with a bonus;

when the base-game outcome is associated with a bonus:

display a losing outcome comprising a combination of symbols selected from the base-game symbols that comprises a losing base-game outcome, display a notification to the player that a bonus has been awarded, receive an input to the actuator for initiating a gaming event, display an outcome comprising a combination of symbols selected from the base-game symbols that comprises a winning base-game outcome, and award a prize associated with the winning base-game outcome.

16. The non-transitory computer readable medium of claim 15, wherein receipt of an input to the actuator for initiating a gaming event includes receipt of the input from a player.

17. The non-transitory computer readable medium of claim 15, wherein the plurality of instructions, when executed by the at least one processor further cause the at least one processor to display the losing outcome for a predefined period of time.

18. The non-transitory computer readable medium of claim 15, wherein the plurality of instructions, when executed by the at least one processor, further cause the at least one processor to:

select a bonus value; and ascertain that the gaming event is not associated with a bonus when the selected bonus-value does not meet a predefined criterion.

19. The non-transitory computer readable medium of claim 18, wherein the plurality of instructions, when executed by the at least one processor, further cause the at least one processor to ascertain that the gaming event is associated with a bonus when the base-game outcome is a losing outcome and when the selected bonus value meets the predefined criterion.

20. The gaming device of claim 15 wherein the symbols appear on reels that spin.

21. The gaming device of claim 15 wherein the symbols appear on images of playing cards.

* * * * *